US009995056B2

(12) United States Patent
Yang

(10) Patent No.: US 9,995,056 B2
(45) Date of Patent: Jun. 12, 2018

(54) COLLAPSIBLE GAZEBO FRAME WITH SINGLE ACTIVATION FEATURE

(71) Applicant: Shengyong Yang, Shanghai (CN)

(72) Inventor: Shengyong Yang, Shanghai (CN)

( * ) Notice: Subject to any disclaimer, the term of this patent is extended or adjusted under 35 U.S.C. 154(b) by 605 days.

(21) Appl. No.: 14/321,008

(22) Filed: Jul. 1, 2014

(65) Prior Publication Data

US 2016/0002949 A1 Jan. 7, 2016

(51) Int. Cl.
*E04H 15/46* (2006.01)
*E04H 15/50* (2006.01)
*E04H 15/60* (2006.01)

(52) U.S. Cl.
CPC ..... *E04H 15/46* (2013.01); *E04H 15/50* (2013.01); *E04H 15/60* (2013.01)

(58) Field of Classification Search
CPC ..... E94H 15/50; E94H 15/60
See application file for complete search history.

(56) References Cited

U.S. PATENT DOCUMENTS 5,444,946 A * 8/1995 Zeigler ..... E04H 15/50 135/122
5,490,532 A * 2/1996 Mallookis ..... E04H 15/50 135/114
6,152,157 A * 11/2000 Jang ..... E04H 15/50 135/126
7,240,686 B2 * 7/2007 Seo ..... E04H 15/50 135/131
7,299,813 B2 * 11/2007 Ochi ..... E04H 15/50 135/131
7,422,026 B2 * 9/2008 Kim ..... E04H 15/50 135/120.2
2002/0074032 A1 * 6/2002 Park ..... E04H 15/50 135/131
2005/0257817 A1 * 11/2005 Kuo ..... A45B 25/006 135/24
2015/0247339 A1 * 9/2015 Lee ..... E04H 15/50 135/145
2015/0308147 A1 * 10/2015 Lee ..... E04H 1/1205 135/145
2016/0348392 A1 * 12/2016 Jin ..... E04H 15/02
2016/0348395 A1 * 12/2016 Jin ..... E04H 15/50

FOREIGN PATENT DOCUMENTS

WO WO 2017028659 A1 * 2/2017 ..... E05B 65/00

* cited by examiner

*Primary Examiner* — David R Dunn
*Assistant Examiner* — Danielle Jackson
(74) *Attorney, Agent, or Firm* — Houda Nounou

(57) ABSTRACT

A collapsible canopy frame includes a plurality of side and central supports and a plurality of telescopic legs. A single activation feature provides for the extension and retraction, and the locking and unlocking of the canopy frame. A fixed bracket and a sliding bracket located at the upper end of each telescopic leg provide the connection of the telescopic legs to the side and central supports and to each other. The single activation feature includes an upper and a lower hub and when they joined together facilitate the extension and locking of canopy frame; as the lower hub is disengaged from the upper hub, the gazebo frame becomes unlocked and capable of being retracted. Each telescopic leg includes a plurality of telescopic sections that extend and retract through a cable system or a tape-driven system connected to the sliding bracket and which links the telescopic sections to each other.

2 Claims, 31 Drawing Sheets

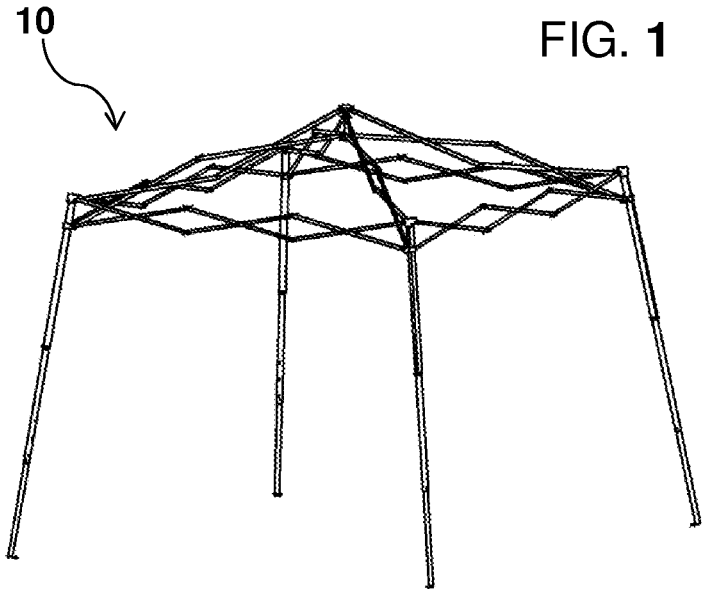
FIG. 1
FIG. 2
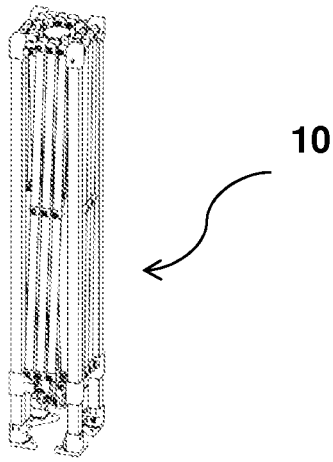

FIG. 21
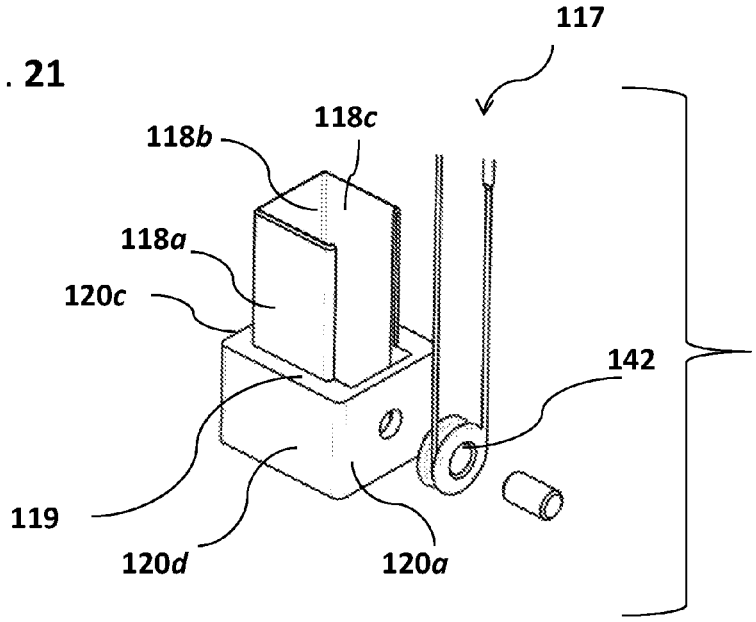
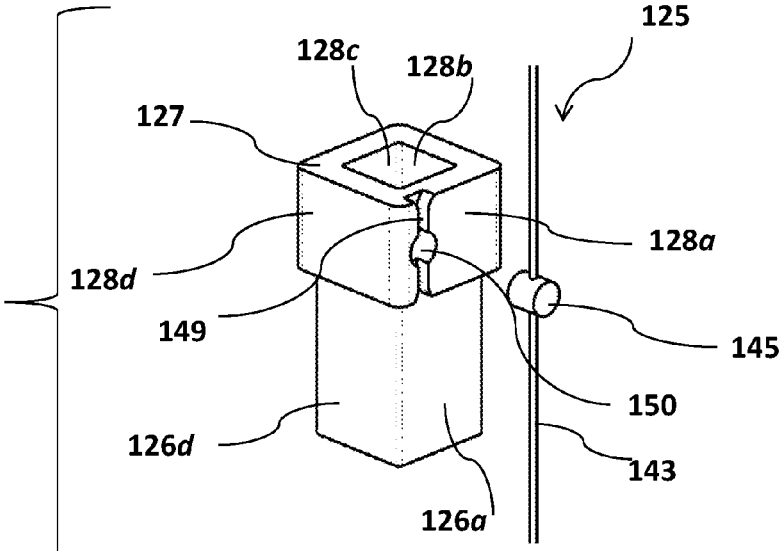
FIG. 22

FIG. 27
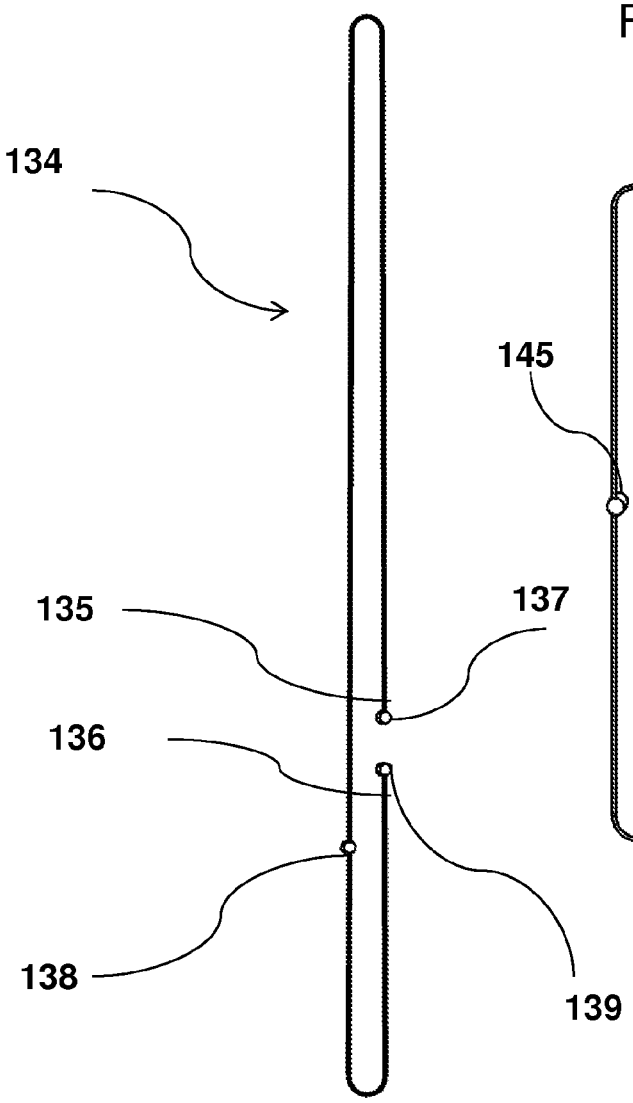
FIG. 28
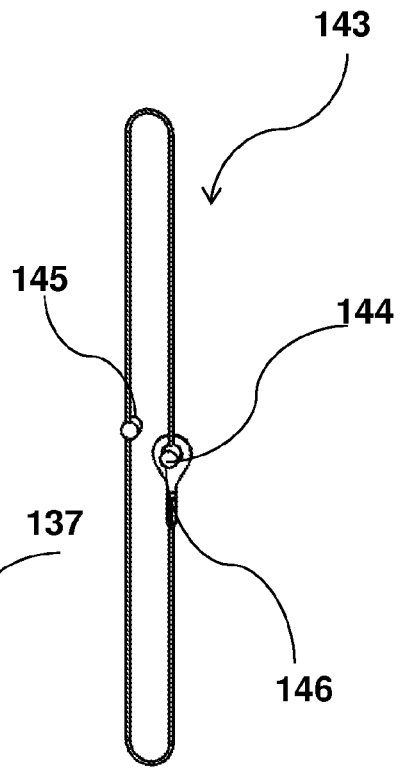

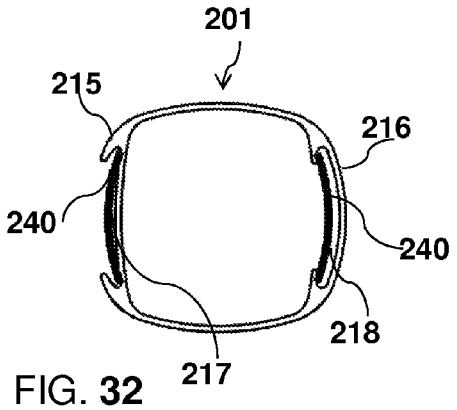
FIG. 32
FIG. 31
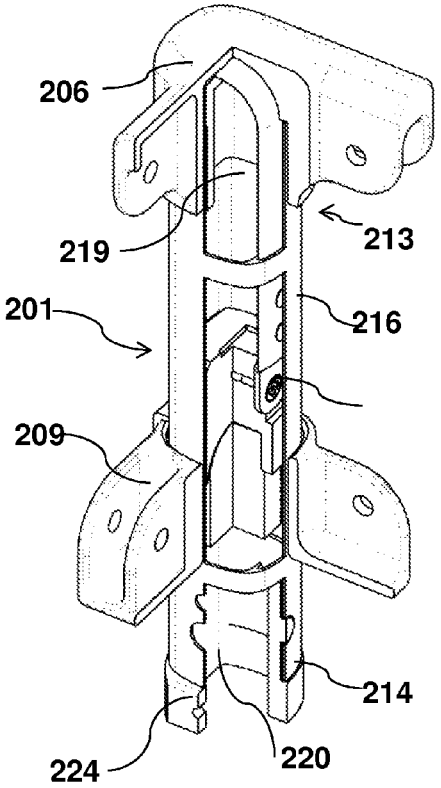
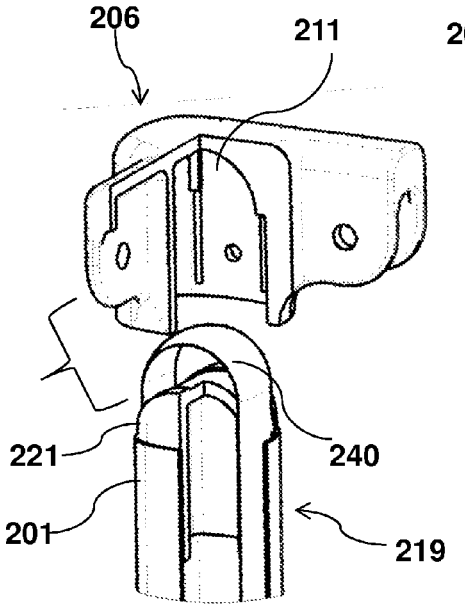
FIG. 33

FIG. 34

FIG. 43
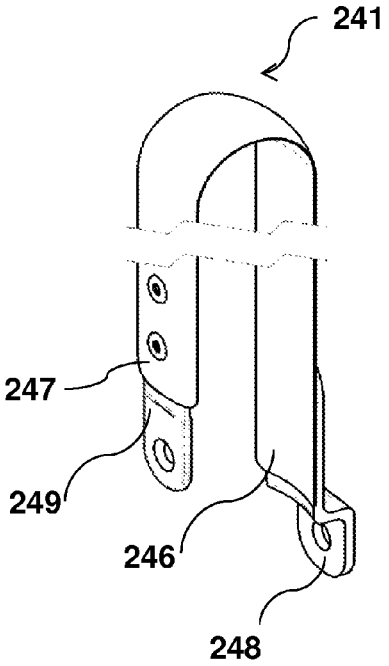
FIG. 44
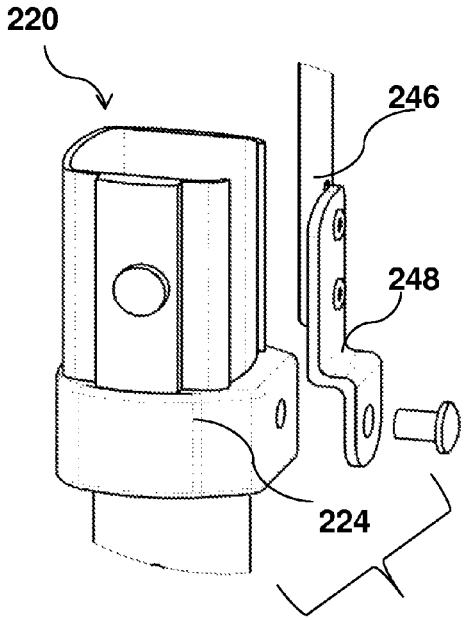
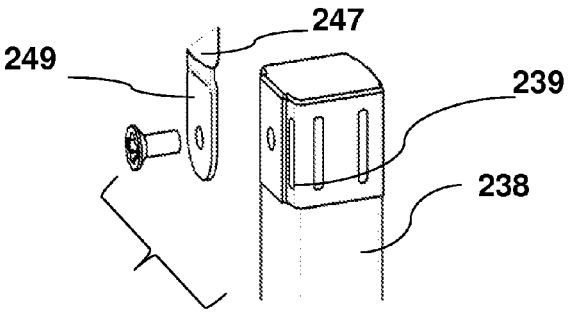
FIG. 45

FIG. 46
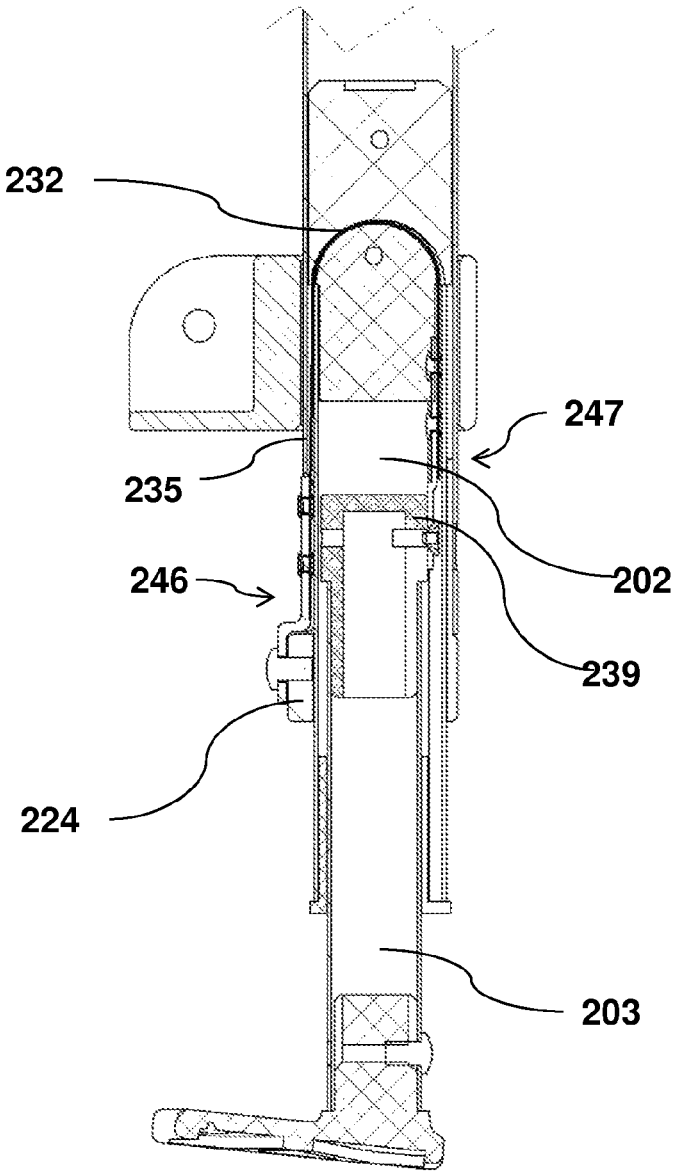

COLLAPSIBLE GAZEBO FRAME WITH SINGLE ACTIVATION FEATURE

BACKGROUND

The statements in this section merely provide background information related to the present disclosure and may not constitute prior art.

FIELD OF THE INVENTION

The present disclosure relates to collapsible structures and, more specifically, to a collapsible gazebo structure whose size is reduced upon collapsing.

DESCRIPTION OF THE RELATED ART

There are a number of temporary gazebo and canopy structures that are designed to be transported and set up for a variety of uses. Generally, the gazebo and canopy structures include several legs, a central pole and side support brace structures. Commonly the legs are in two or three sections arranged to telescope within one another to achieve a retracted position and an extended position for use. Typically, the side support brace structure is a scissor arrangement which enables the gazebo structure to be compressed for storage and extended for use.

A problem with current collapsible gazebo and canopy structures is that the user must make numerous steps to open or close the gazebo structure from its collapsed or opened state, respectively. For example, to open the canopy frame structure from its collapsed state, the user must manually extend each side support and lock in place each side support; then, the user must extend each leg to a desired length and lock each telescopic section of each leg. Thus, each telescopic section of each leg and each side support, or other type of supports, must be individually and manually opened and locked before the gazebo structure is fully opened. To collapse the canopy frame from its open state, opposing steps are taken to unlock each telescopic section and each support, then retract each telescopic leg and each support before collapsing the gazebo. Therefore, it is desirable to have a gazebo frame structure that can be opened, closed, locked and unlocked by a single feature while maintaining a reduced size of the canopy frame for storage.

SUMMARY

The inventor hereof has succeeded at designing a gazebo frame structure capable of being collapsed, opened and securely locked and unlocked through a single activation feature, as well as having a gazebo frame that is reduced in size for ease in storage.

According to one aspect, a collapsible gazebo frame assembly includes a plurality of telescopic legs, a single activation point mechanism, and a plurality of central and side scissor supports. The central supports are provided for the coupling of the single activation feature directly to the telescopic legs. The upper and lower arms of one end of each central support are attached to the single activation feature. The telescopic legs are connected to each other by the side supports. Each end of side supports and one end of the central supports connect to each of the telescopic leg at two points: the upper arm of each side support and the upper arm of one end of each of the central supports connect to a fixed bracket found at the top end of each of the telescopic leg, and the lower arm of each side support and the lower arm of one end of the central support connect to a sliding bracket member located on the telescopic leg and below the fixed bracket.

According to another aspect, the collapsible gazebo frame structure is opened and closed by a single activation feature. The single activation feature includes a lever connected its lower end and is used to trigger the locking and unlocking of the single activation feature. The sliding bracket causes the telescopic legs to open and close as the sliding bracket shifts up and down respectively.

According to yet another aspect, a collapsible gazebo frame assembly includes a plurality of telescopic legs. The telescopic legs may consist of two or more telescopic sections. The telescopic sections extend when the sliding bracket moves upwardly and retract when the sliding bracket moves downwardly. The movement of the telescopic sections is achieved through the use of cable or tape assemblies found in each telescopic leg. The telescopic legs do not contain any locking mechanism on their own rather the telescopic legs remain in extended and in locked position when the single activation point mechanism is in the locked position.

Further aspects of the present disclosure will be in part apparent and in part pointed out below. It should be understood that various aspects of the disclosure may be implemented individually or in combination with one another. It should also be understood that the detailed description and drawings, while indicating certain exemplary embodiments, are intended for purposes of illustration only and should not be construed as limiting the scope of the disclosure.

BRIEF DESCRIPTION OF THE DRAWINGS

FIG. 1 is a perspective view of an opened collapsible gazebo frame with single activation feature;

FIG. 2 is a perspective view of a closed collapsible gazebo frame with single activation feature;

FIG. 21 illustrates a perspective view of the bottom fitting sleeve and a partial exploded view of lower cable assembly;

FIG. 22 illustrates a perspective view of bottom plug and a partial exploded view of lower cable assembly;

FIG. 27 illustrates the top cable with a plurality of dowels;

FIG. 28 illustrates the bottom cable with a pair of dowels and a ring terminal.

FIG. 31 illustrates a longitudinal section view of the top telescopic section with the fixed bracket and the sliding bracket;

FIG. 32 illustrates a cross sectional view of the top telescopic section with upper tape in tracks;

FIG. 33 illustrates a partially broken-away perspective view of top plug and fixed bracket;

FIG. 43 illustrates the lower tape with fasteners;

FIG. 44 illustrates the first end of lower tape and location of attachment on the collar of the middle fitting sleeve;

FIG. 45 illustrates the second end of lower tape and location of attachment on the collar of bottom plug; and FIG. 46 illustrates a longitudinal section view of the middle and bottom telescopic sections with the lower tape.

DETAILED DESCRIPTION

The following description is merely exemplary in nature and is not intended to limit the present disclosure or the disclosure's applications or uses.

Figure 3:
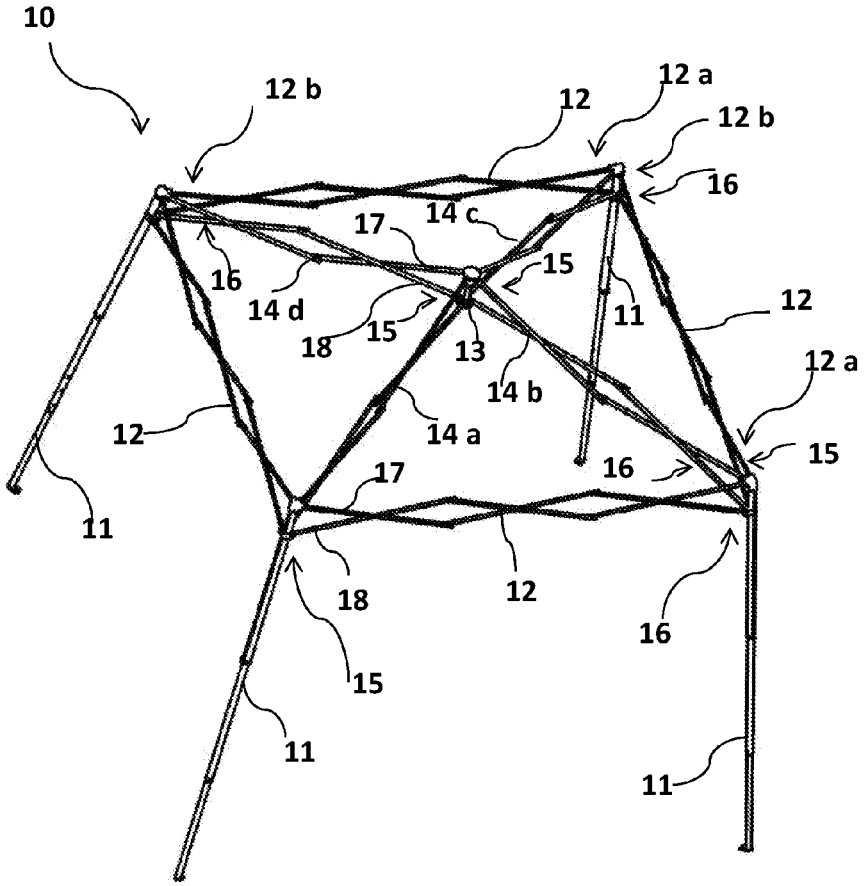
FIG. 3 is a perspective view of a collapsible gazebo frame with single activation feature in an exemplary embodiment according to the present invention in a fully extended state.
Figure 4:
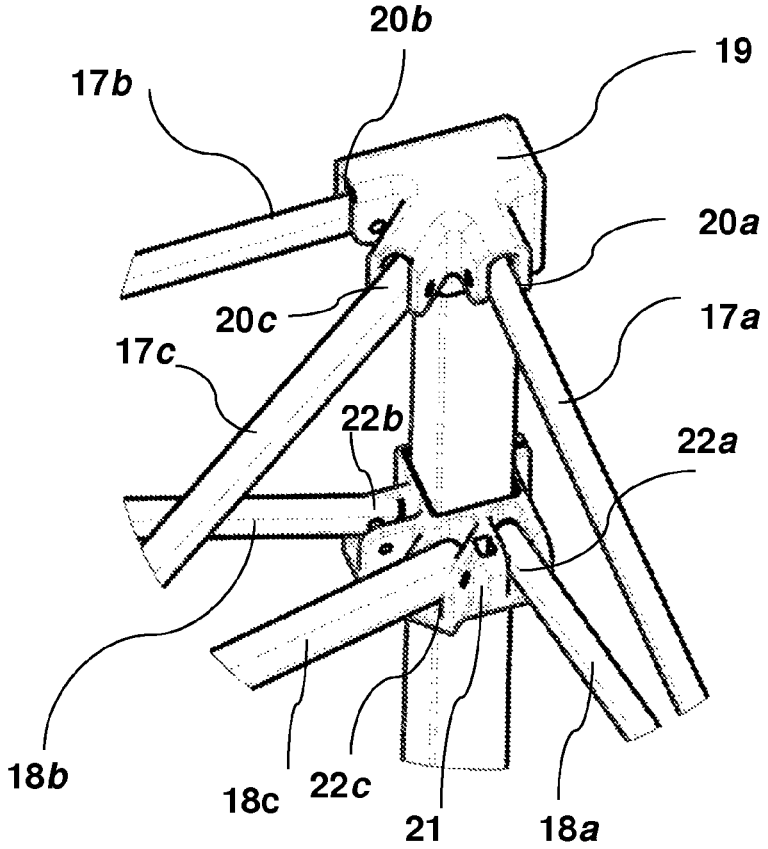
FIG. 4 illustrates a fixed bracket and a sliding bracket.
Figure 5:
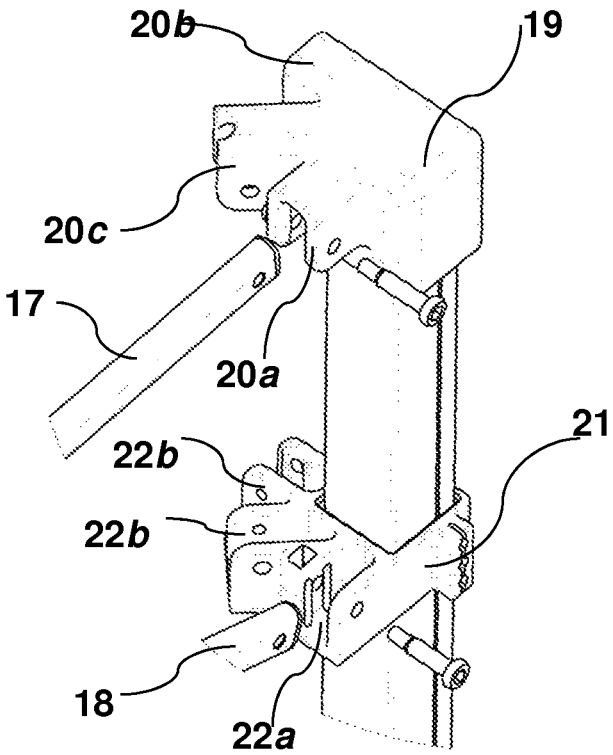
FIG. 5 illustrates an upper arm and a lower arm attachment to the fixed and sliding bracket.

As shown in FIGS. 1 and 2, a collapsible gazebo frame structure 10 in an open (erected) state and in a closed (collapsed) state. FIG. 3 illustrates the collapsible gazebo frame 10 which includes a plurality of telescopic legs 11, a plurality of side supports 12 that connects two adjacent telescopic legs 11 to each other, a cable-pin single activation feature 13, and a plurality of central supports 14 connecting the single activation feature 13 to each of the telescopic legs 11. Even though the present example includes four telescopic legs 11 for a quadrilateral gazebo, the collapsible gazebo frame 10 may have more than four telescopic legs 11 depending on the desired final shape of the gazebo such as a pentagon with five telescopic legs or a hexagon with six telescopic legs. Such side supports 12 and central supports 14 can be of any configuration and in some includes a scissors or x-shaped frame. The side supports 12 and the central supports 14 can be made of materials such as aluminum or stainless steel. The cable-pin single activation feature 13 may be located in the center or off-center of the collapsible gazebo frame 10. When the shape of the collapsible gazebo frame 10 and/or the location of the single activation feature 13 are different than the present embodiment, those skilled in the art would appreciate that the length of the central supports 14 and side supports 12 should be adjusted accordingly. As shown in FIG. 3, each side support 12 and central support 14 has a first end 15 and a second end 16. Each end of the side support and central support includes an upper arm 17 and a lower arm 18. As show in FIGS. 4 and 5, a fixed bracket 19 is mounted at the top of each telescopic leg 11 and includes a first coupler 20*a* for the attachment of the upper arm 17*a* of the first side support 12*a*, a second coupler 20*b* for the attachment of the upper arm 17*b* of the second side support 12*b*, and a third coupler 20*c* for the attachment of the upper arm 17*c* of the second end of the central support 14*a*. A sliding bracket 21 (FIG. 4) is attached to each telescopic leg and is movable between a first position for gazebo frame storage (retracted position) and a second position for gazebo deployment (extended position). The sliding bracket 21 has a first coupler 22*a* for the attachment of the lower arm 18*a* of the first side support 12*a*, second coupler 22*b* for the attachment of the lower arm 18*b* of the second side support 12*b*, and a third coupler 22*c* for the attachment of the lower arm 18*c* of the second end of the central support 14*a*. Incorporated in all first ends and second ends 15, 16 of the upper and lower arms 17, 18 of both the side supports 12 and central supports 14 is a hole to facilitate the attachment to the telescopic legs and single activation feature as will be described below. The upper arms 17 and the lower arms 18 of the side supports 12 and the central supports 14 are pivotably attached to the respective couplers using screws, bolts and nuts combination, and/or any other similar attachment.

Figure 6:
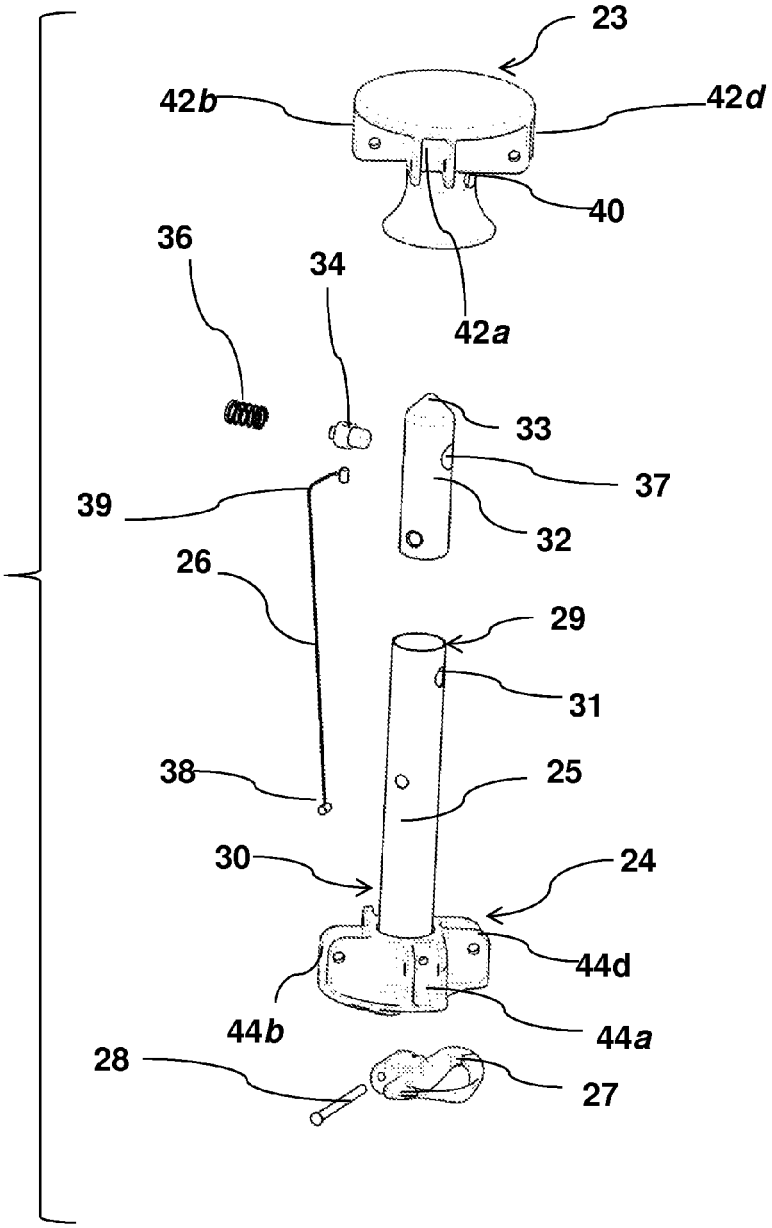
FIG. 6 is an exploded view of a cable-pin single activation feature.
Figure 7:
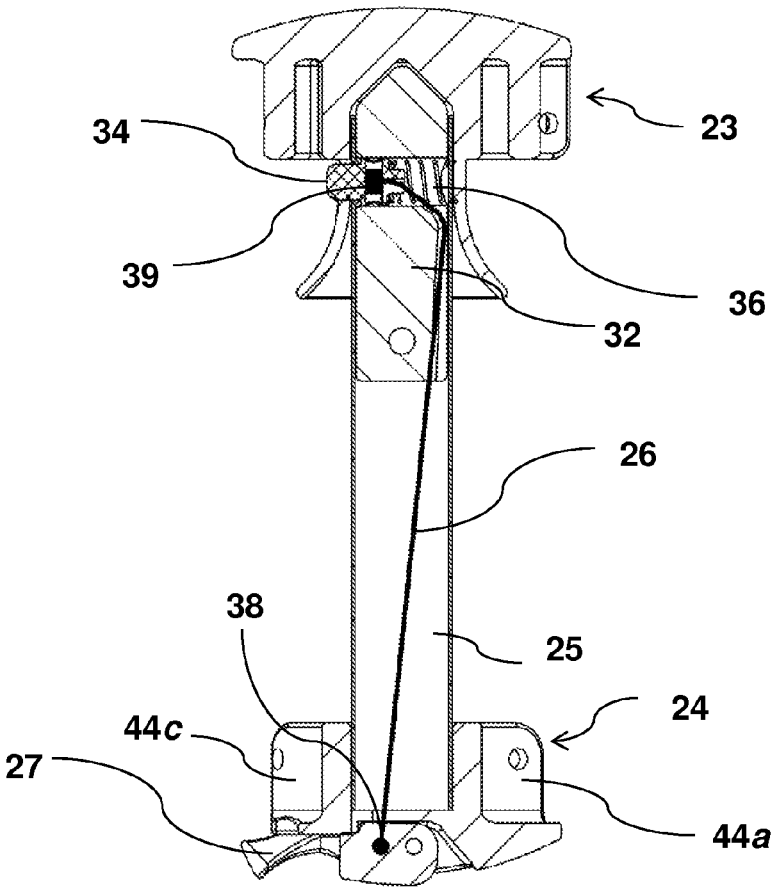
FIG. 7 illustrates a longitudinal section view of the cable-pin single activation feature.
Figure 8:
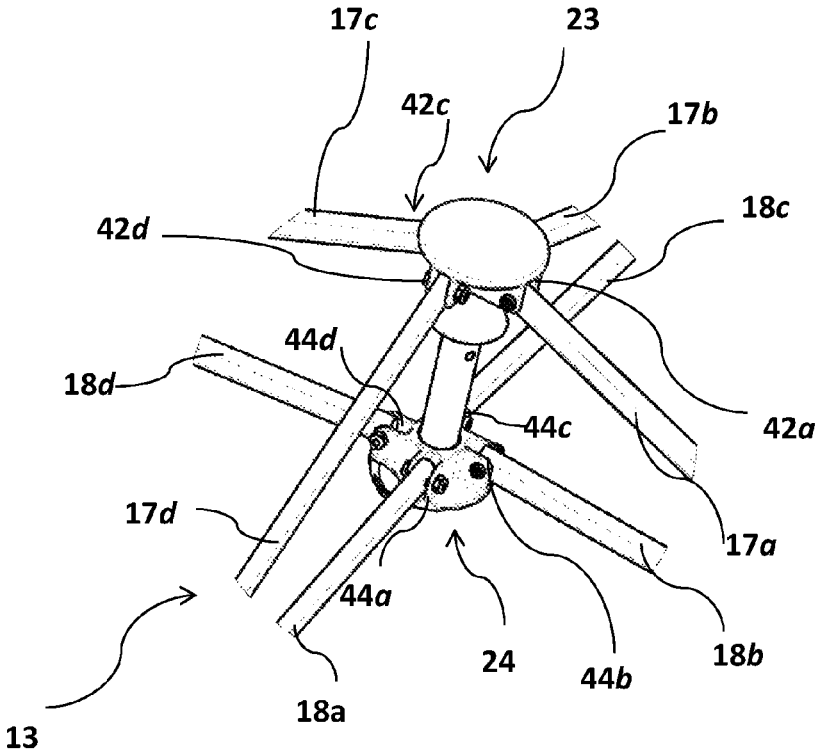
FIG. 8 illustrates the cable-pin single activation feature in an engaged state with a plurality of couplers.
Figure 9:
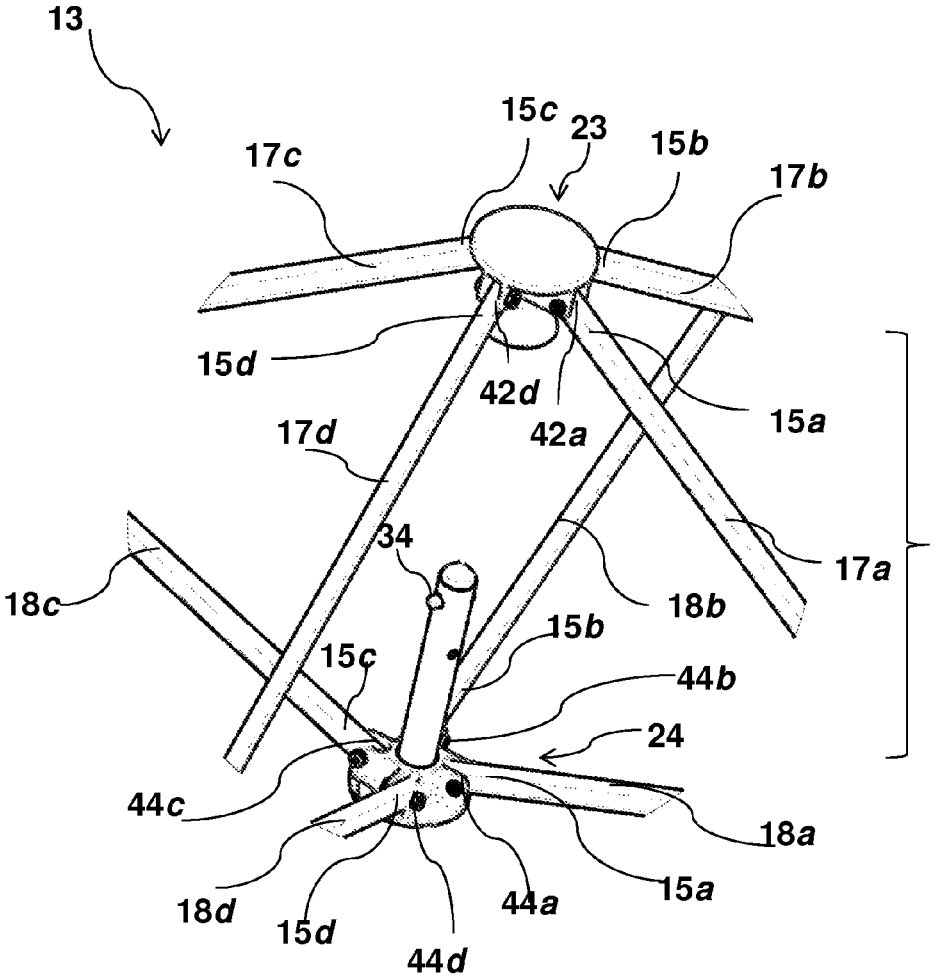
FIG. 9 illustrates the cable-pin single activation feature in a disengaged state.

FIGS. 6-9 illustrate a cable-pin single activation feature 13. As shown in FIG. 6, the cable-pin single activation feature 13 includes an upper hub 23, a lower hub 24 with a pole 25 and a cable 26; a lever 27 is attached to the lower hub 24 by a pivot pin, and the pole 25 has an upper end 29 and a lower end 30; the lower end 30 of the pole 25 is attached to the lower hub 24; the interior of the upper end 29 of the pole 25 includes an opening 31 on the upper side wall of the pole 25 and a housing 32; the housing 32 is hollow with a tapered upper end 33 and houses a locking pin 34, a return spring 36, and also the housing 32 includes an opening 37 on its side wall; the opening 31 found on the upper side wall of the pole 25 aligns with the opening 37 of the housing's 32 side wall where the locking pin 34 exits the pole 25; the cable 26 has a first end 38 and a second end 39;

and the upper hub 23 includes an opening 40 found on its side wall. As shown in FIG. 7, the first end 38 of the cable 26 is attached to the lever 27 and the second end 39 of the cable 26 is connected to the locking pin 34. For achieving the open position of the gazebo frame structure 10, the lower hub 24 with the pole 25 and its housing 32 is moved upward and into the upper hub 23. The upper hub 23 is "horn" shaped which serves as a guide for aligning the upper end 29 of the pole 25 with the upper hub 23 and thus ensuring that the locking pin 34 is pressed inward into the housing's opening 37 and retracted backward from the opening 37 during the engagement and disengagement of the lower hub 24 from the upper hub 23. As the locking pin 34 is aligned with the upper hub's 23 opening 40, the return spring 36 pushes the locking pin 34 outward through the opening 40 and the upper hub 23 and lower hub 24 are engaged in a locked position. To unlock the cable-pin single activation feature 13, the lever 27 is pressed downward as the lever rotates around the pivot pin 28 which triggers the cable 26 to pull the locking pin 34 inward into the housing 32 and release the lower hub 24 from the upper hub 23. As shown in FIGS. 8 and 9, the upper hub 23 includes a plurality of couplers 42: A first coupler 42*a* for attaching the upper arm 17*a* of the first end 15*a* of the first central support 14*a*, a second coupler 42*b* for attaching the upper arm 17*b* of the first end 15*b* of the second central support 14*b*, a third coupler 42*c* for attaching the upper arm 17*c* of the first end 15*c* of the third central support 14*c*, and a fourth coupler 42*d* for attaching the upper arm 17*d* of the first end 15*d* of the fourth central support 14*d*; and the lower hub 24 includes a plurality of couplers 44: A first coupler 44*a* for attaching the lower arm 18*a* of the first end 15*a* of the first central support 14*a*, a second coupler 44*b* for attaching the lower arm 18*b* of the first end 15*b* of the second central support 14*b*, a third coupler 44*c* for attaching the lower arm 18*c* of the first end 15*c* of the third central support 14*c*, and a fourth coupler 44*d* for attaching the lower arm 18*d* of the first end 15*d* of the fourth central support 14*d*. As the lower hub 24 moves upward and is in locked position with the upper hub 23, the central supports' 14 lower arm 18 of the second end 16 which are connected to the telescopic legs 11 at the sliding bracket 21 causes the sliding brackets 21 to move upward and the telescopic legs 11 to automatically extend. As shown in FIG. 9, to retract the telescopic legs 11, the lower hub 24 is disengaged from upper hub 23 causing the sliding brackets 21 to move downward and the telescopic legs to retract.

Figure 10:
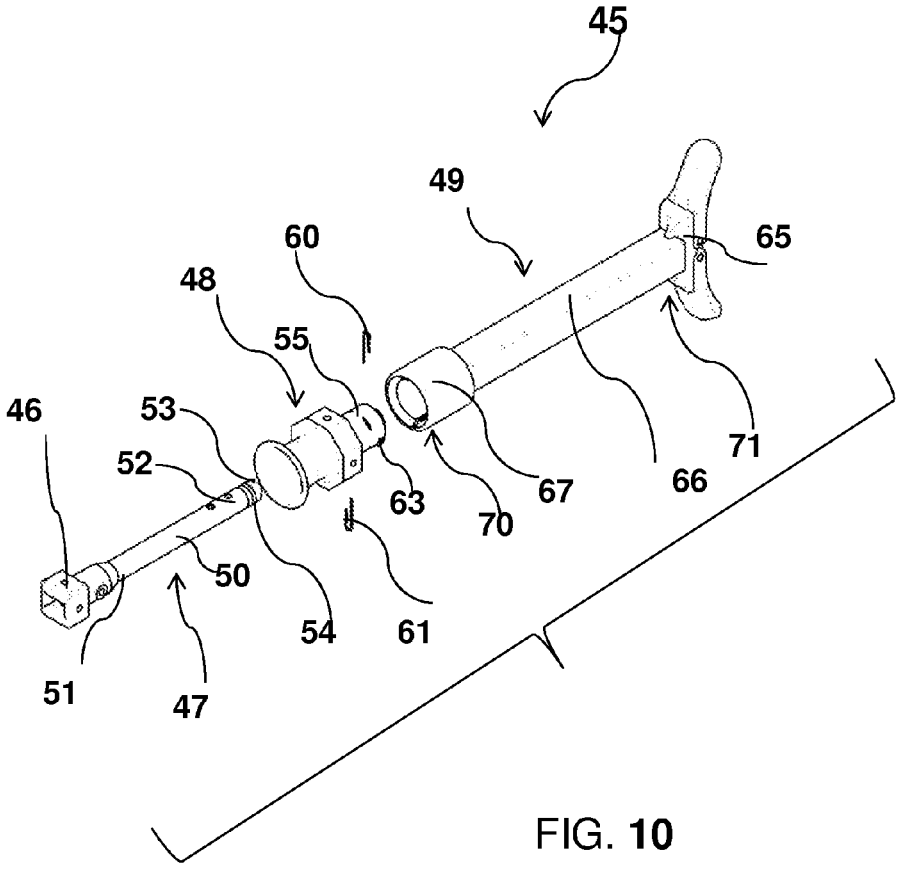
FIG. 10 is an exploded view of a rotational push-pull single activation feature.
Figure 11:
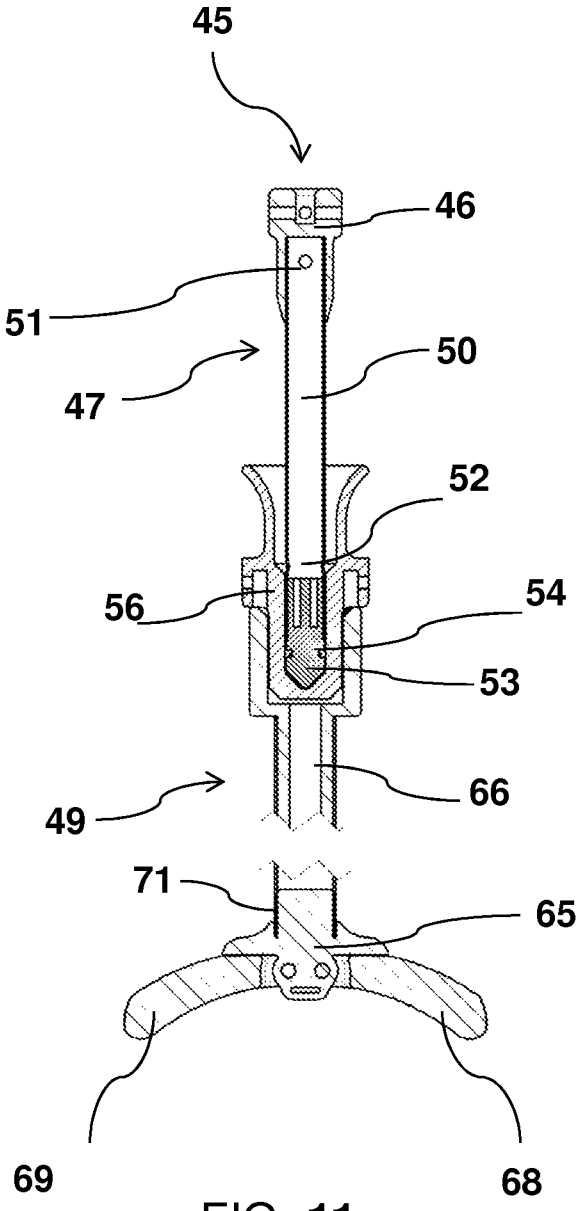
FIG. 11 illustrates a longitudinal section view of the rotational push-pull activation feature.
Figure 12:
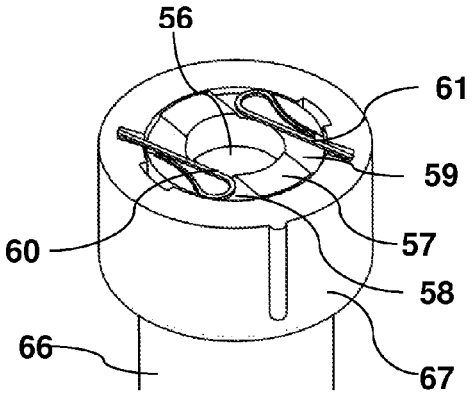
FIG. 12 illustrates a cross sectional view of the rotational push-pull activation feature's lower hub housing in disengaged state from the upper hub.
Figure 13:
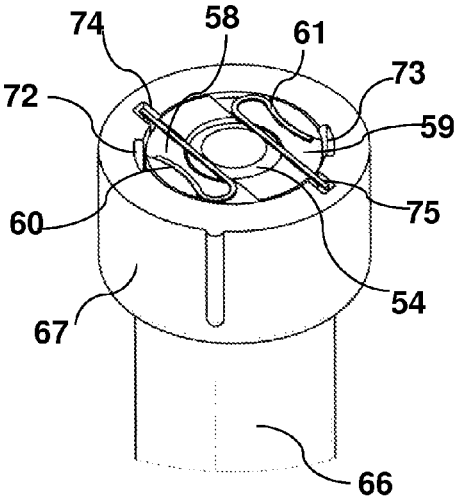
FIG. 13 illustrates a cross sectional view of the rotational push-pull activation feature's lower hub housing and of a tapered plug within the housing in an engaged state.
Figure 14:
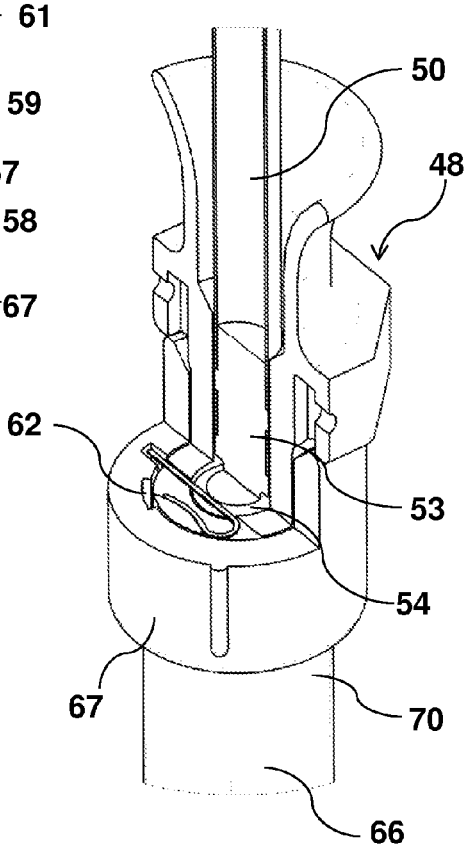
FIG. 14 illustrates a partial cross sectional view and a partial longitudinal view of the rotational push-pull activation feature with the upper hub and the lower hub in engaged state.
Figure 15:
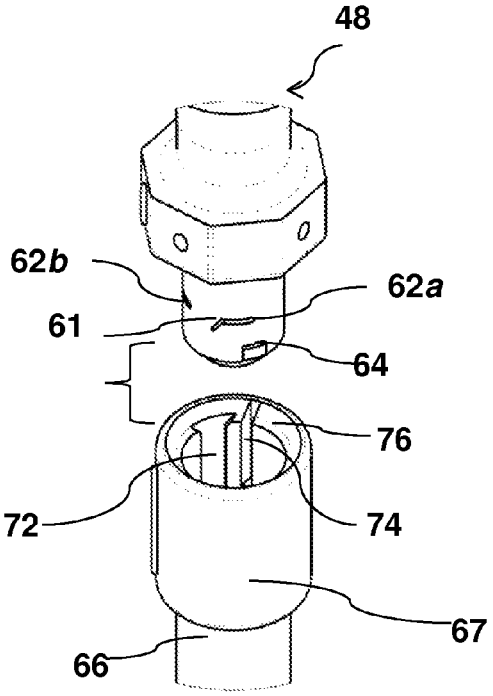
FIG. 15 illustrates a partial perspective view of the lower hub in relation to a release sleeve.
Figure 16:
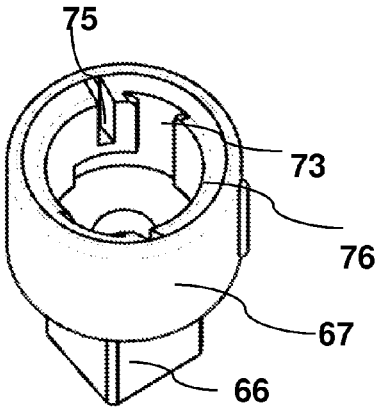
FIG. 16 illustrates a perspective view of the release sleeve's sidewall.

FIGS. 10-17 illustrate an additional embodiment for the single activation feature. As shown in FIGS. 10 and 11, a rotational push-pull single activation feature 45 includes an upper hub 46, a connection tube assembly 47, a lower hub assembly 48, and a push-pull handle assembly 49. The connection tube assembly 47 consists of a connection tube 50 with a first end 51 and a second end 52 and a tapered plug 53. The first end 51 of the connection tube 50 is attached to the upper hub 46 with a screw, or equivalent. The tapered plug 53 is attached to the second end 52 of the connection tube 50. The tapered plug 53 includes a groove 54 all along the perimeter of the cylinder portion of the tapered plug 53. As shown in FIG. 10, the lower hub assembly 48 includes a hollow housing 55 with a thick wall 56. FIGS. 12-14 illustrate the hollow housing 55 where a pair of parallel channels, a first channel 58 and a second channel 59 are located in the thick wall 56 of the housing 55; the channels 58, 59 extend from one sidewall to the opposite sidewall; and two cotter pins, a first cotter pin 60 and a second cotter pin 61, are placed in the first and second channel 58, 59 where one side of the cotter pin extends into the hollow space of the housing 55. FIG. 12 illustrates the position of the cotter pins 60, 61 in the channels 58, 59 when the lower hub assembly 48 is disengaged from the upper hub 46; and FIG. 13 and FIG. 14 illustrate the position of the cotter pins 60, 61 in the channels 58, 59 when the lower hub assembly 48 is engaged with the upper hub 46. As shown in FIG. 15, the sidewalls of the lower hub assembly 48 contain a plurality of horizontal slots 62 formed by the two parallel channels 58, 59 allowing the first and second cotter pins 60, 61 to extend beyond the wall of the lower hub's housing 56 and through the horizontal slots 62 which may be seen from the exterior side of the sidewall. A pair of tabs, a first tab 63 and a second tab 64, are located on the outer edge of the lower hub assembly 48 as shown in FIGS. 10 and 15. Referring back to FIGS. 10 and 11, the detachable push-pull handle assembly 49 includes a foldable handle 65 and an extension tube 66 with a release sleeve 67. The detachable push-pull handle assembly 49 is designed to allow the user to detach the push-pull handle assembly 49 after the collapsible gazebo frame 10 is opened and closed to provide an open unobstructed space and to reduce the size of the collapsed gazebo frame 10, respectively. The foldable handle 65 includes a right side 68 and a left side 69 where the right side 68 and left side 69 are attached by a pivot pin, or equivalent. The extension tube 66 has an upper end 70 and a lower end 71. The release sleeve 67 is located at the upper end 70 of the extension tube 66 and is secured by a screw, or equivalent. As shown in FIGS. 15 and 16, the release sleeve 67 has a sidewall 76 which contains a pair of "L" shaped recesses, a first "L" recess 72 and a second "L" recess 73 which are located 180 degrees from each other to accommodate the tabs 63, 64 during the locking and unlocking. Additionally, a pair of vertical slots, a first slot 74 and a second slot 75, are located on the sidewall 76 of the release sleeve 67 to allow the insertion of the exposed end of the first and second cotter pins 60, 61 during the unlocking process. The lower end 71 of the extension tube 66 is connected to the foldable handle 65 by a screw, or equivalent.

Figure 17:
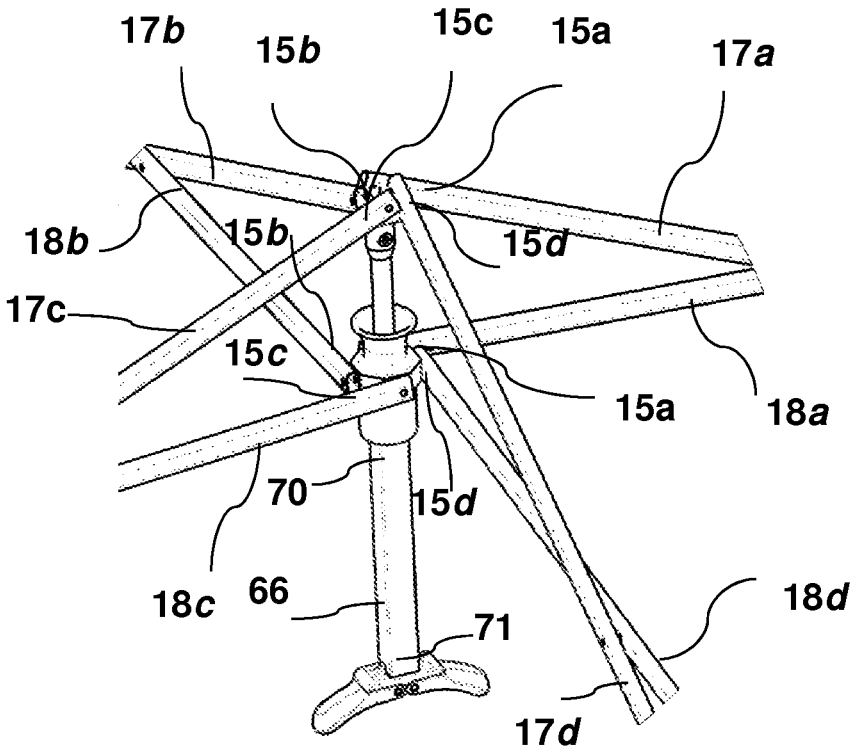
FIG. 17 illustrates the rotational push-pull activation feature with an upper hub and a lower hub in an engaged state with a plurality of couplers.

As shown in FIG. 17, attached to the upper hub 46 are the upper arm 17*a* of the first end 15*a* of the first central support 14*a*, the upper arm 17*b* of the first end 15*b* of the second central support 14*b*, the upper arm 17*c* of the first end 15*c* of the third central support 14*c*, and the upper arm 17*d* of the first end 15*d* of the fourth central support 14*d*. A bolt, or equivalent, is used to attach each upper arm 17 of the central supports 14 to the upper hub 46. Attached to the lower hub assembly 48 are the lower arm 18*a* of the first end 15*a* of the first central support 14*a*, the lower arm 18*b* of the first end 15*b* of the second central support 14*b*, the lower arm 18*c* of the first end 15*c* of the third central support 14*c* and the lower arm 18*d* of the first end 15*d* of the fourth central support 14*d*. Screws, or equivalent, are used to attach the lower arms of the central support to the lower hub assembly 48.

As illustrated in FIG. 15, the extension and the locking of the telescopic legs are achieved once the release sleeve 67 of the detachable push-pull handle assembly 49 engages with the lower hub assembly 48. Specifically, as the tabs 63, 64 reach the horizontal section of the "L" shaped recesses 72, 73, the lower hub assembly 48 is pushed upward so that the exposed sides of the cotter pins 60, 61 are aligned and in the groove 54 of the tapered plug 53 and the upper hub 46 and lower hub assembly 48 are engaged and the locked position is achieved; as the lower hub assembly 48 is moved upward, the sliding bracket 21 on each telescopic leg 11 also moves upward causing each telescopic leg 11 to extend and then to lock as the upper hub 46 and the lower hub assembly 48 are locked. To initiate the unlocking of the rotational push-pull single activation feature 45, first the detachable push-pull handle assembly 49 (specifically, the release sleeve 67) engages with the lower hub assembly 48 when the tabs 63, 64 are in the horizontal section of L shaped recesses 72,73 and the exposed ends of the cotter pins 60, 61 are in the vertical slots 74, 75 of the release sleeve 67; next, the user rotates the push-pull handle assembly 49 and the rotational force causes the side of the cotter pins 60,61 to exit the groove 54 of tapered plug 53, and the upper hub 46 is disengaged from the lower hub assembly 48 and the gazebo frame 10 is in the unlock position and capable of being collapsed. Finally, the user pulls down the push-pull handle assembly 49 and the tabs 63, 64 of the lower hub assembly 48 are in the horizontal section of the L shaped recesses 72, 73 of the release sleeve 67 allowing the lower hub assembly 48 to move downward which triggers the sliding bracket 21 on each telescopic leg 11 to move downward and each telescopic leg 11 to retract.

Figure 18:
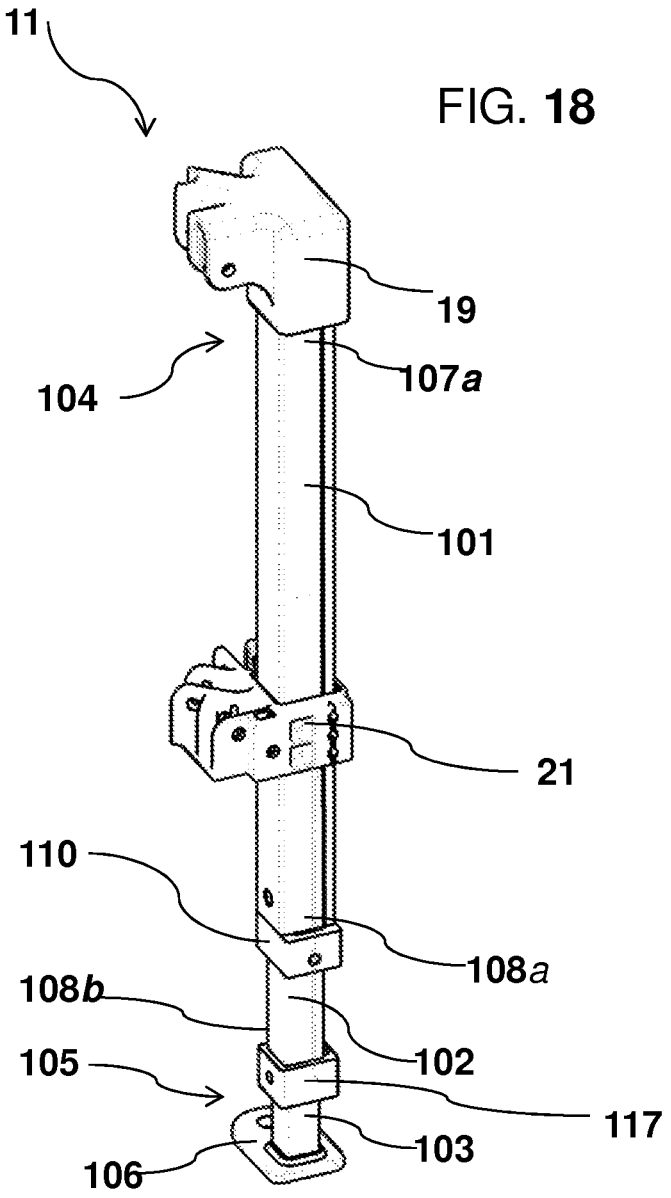
FIG. 18 illustrates a perspective view of a telescopic leg with a cable system.

FIGS. 18-25 illustrate an embodiment of the telescopic leg 11 with a cable system 100 for achieving the extension as well as the retraction of the telescopic leg 11. As shown in FIG. 18, each telescopic leg 11 consists of three sections that telescope within each other: a top telescopic section 101, a middle telescopic section 102 and a bottom telescopic section 103. The telescopic leg 11 has an upper end 104 and a lower end 105. Located at the upper end 104 of each of the telescopic leg 11 is a fixed bracket 19 used for connecting the central supports 14 and side supports 12, and attached to the lower end 105 of the telescopic leg 11 is a pedestal foot 106 to stabilize the telescopic leg 11 when the collapsible gazebo frame 10 is in the open position. The telescopic leg 11 has effectively a square cross-section; in other examples, the telescopic legs 11 may have rectangular or other cross-sectional shapes. Each telescopic section (101, 102, and 103) has an effectively square cross-section, where the cross-section of the middle telescopic section 102 is smaller than the cross-section of the top telescopic section 101, and the cross-section of the bottom telescopic section 103 is smaller than the cross-section of the middle telescopic section 102. Each telescopic section (101, 102, and 103) has an upper end 107 and a lower end 108. Mounted on each top telescopic section 101 but below the fixed bracket 19 is the sliding bracket 21; the sliding bracket 21 moves upward and downward along the outer wall of top telescopic section 101 and its movement is triggered by the single activation feature.

Figure 19:
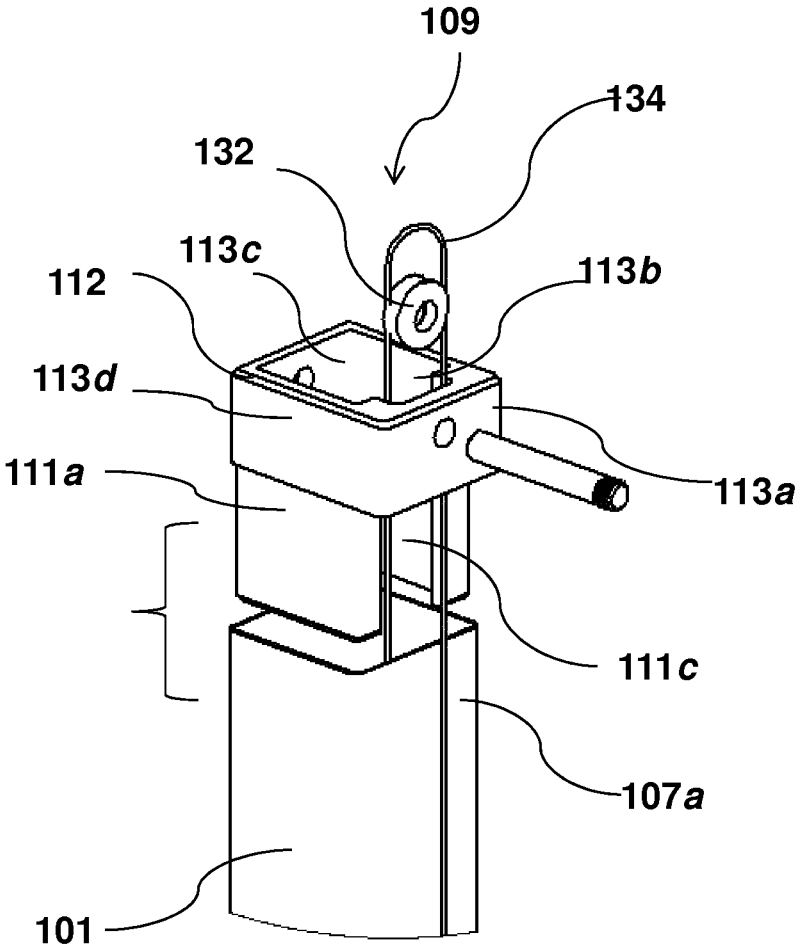
FIG. 19 illustrates an exploded partial view of a top telescopic section with a top fitting sleeve.
Figure 20:
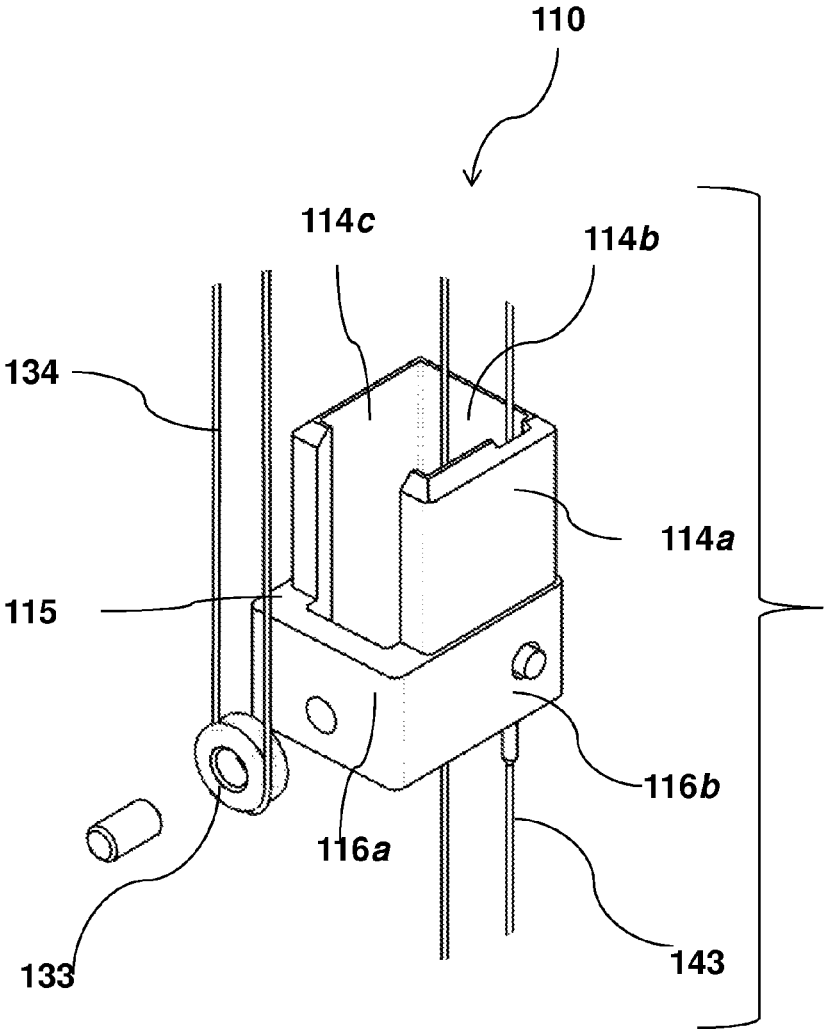
FIG. 20 illustrates a perspective view of the middle fitting sleeve and a partial exploded view of upper cable assembly.

The telescopic top section 101 has two fitting sleeves, a top fitting sleeve 109 and a middle fitting sleeve 110. As shown in FIG. 19, the top fitting sleeve 109 has three sidewalls 111*a*, 111*b* (not shown), and 111*c* designed to fit tightly into the upper end 107*a* of the top telescopic section 101, and a collar 112 with four sidewalls 113*a*, 113*b*, 113*c*, and 113*d* that rests on the outer edge above the upper end 107*a* of the top telescopic section 101. The center of the top fitting sleeve 109 is hollow and the shape of the top fitting sleeve 109 is in the same shape as the cross-section of the top telescopic section 101. As shown in FIG. 20, The middle fitting sleeve 110 has three sidewalls 114*a*, 114*b*, and 114*c* designed to fit tightly into the lower end 108*a* of the top telescopic section 101, and a collar 115 with four sidewalls 116*a*, 116*b*, 116*c*, and 116*d* (not shown) that rests on the outer edge below the lower end 108*a* (not shown) of the top telescopic section 101. The center of the middle fitting sleeve 110 is hollow and the shape of the middle fitting sleeve 110 is in the same shape as the cross-section of the top telescopic section 101.

Figure 23:
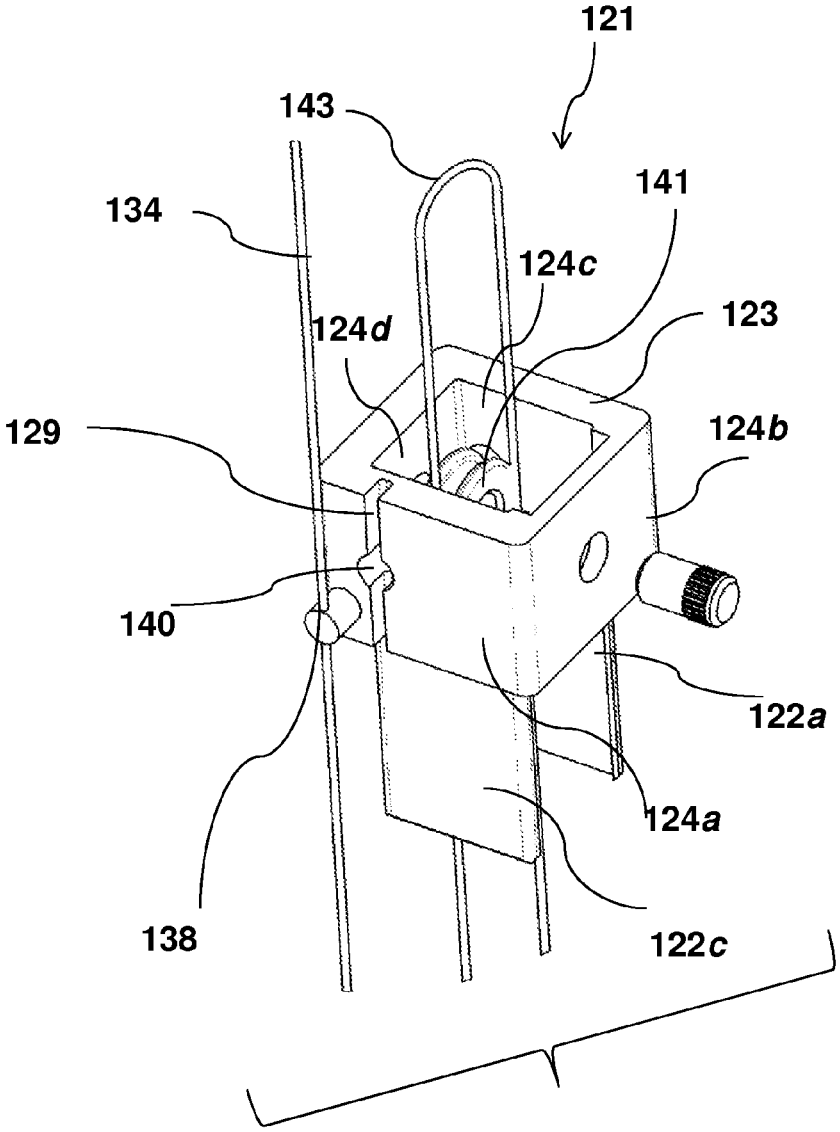
FIG. 23 illustrates a perspective view of middle plug and a partial exploded view of upper cable assembly and lower cable assembly.
Figure 24:
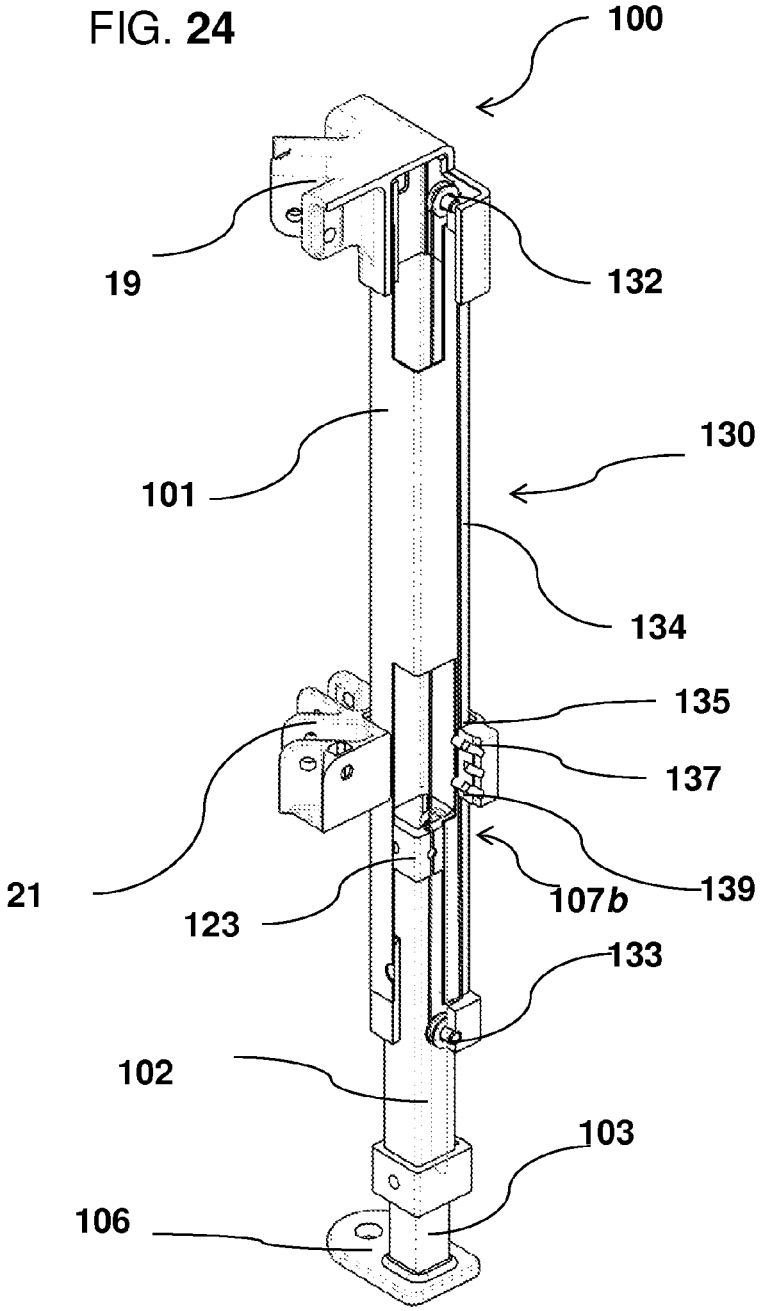
FIG. 24 illustrates a partially broken-away perspective view of telescopic leg with the upper cable assembly.

Referring back to FIG. 18, the middle telescopic section 102 has a bottom fitting sleeve 117. As shown in FIG. 21, the bottom fitting sleeve 117 contains three sidewalls 118*a*, 118*b*, and 118*c* designed to fit tightly into the lower end 108*b* of the middle telescopic section 102, and a collar 119 with four sidewalls 120*a*, 120*b* (not shown), 120*c*, and 120*d* that rests on the outer edge below the lower end 108*b* of the middle telescopic section 102. The center of the bottom fitting sleeve 117 is hollow and the shape of the bottom fitting sleeve 117 is in the same shape as the cross-section of the middle telescopic section 102. As shown in FIGS. 23 and 24, a middle plug 121 with three sidewalls 122*a*, 122*b* (not shown), and 122*c* designed to fit tightly into the upper end 107*b* of the middle telescopic section 102, and a collar 123 with four sidewalls 124*a*, 124*b*, 124*c*, and 124*d* on the outer edge above the upper end 107*b* of the middle telescopic section 102. The center of the middle plug 121 is hollow and the shape of the middle plug 121 is in the same shape as the cross-section of the middle telescopic section 102. FIG. 22 illustrates a bottom plug 125 that is inserted in the upper end 107*c* of the bottom telescopic section 103. As shown in FIG. 22, the bottom plug 125 with four sidewalls 126*a*, 126*b*, 126*c*, and 126*d* is designed to fit tightly into the upper end 107*c* of the bottom telescopic section 103, and a collar 127 with four sidewalls, 128*a*, 128*b*, 128*c*, and 128*d*, which rests on the outer edge above the upper end 107*c* of the bottom telescopic section 103. The center of the bottom plug 125 is hollow and the shape of the bottom plug 121 is in the same shape as the cross-section of the bottom telescopic section 103. The plugs 121, 125 as well as the fitting sleeves 109, 110, 117 can be made of materials such as ABS (Acrylonitrile Butadiene Styrene) or Nylon.

Figure 25:
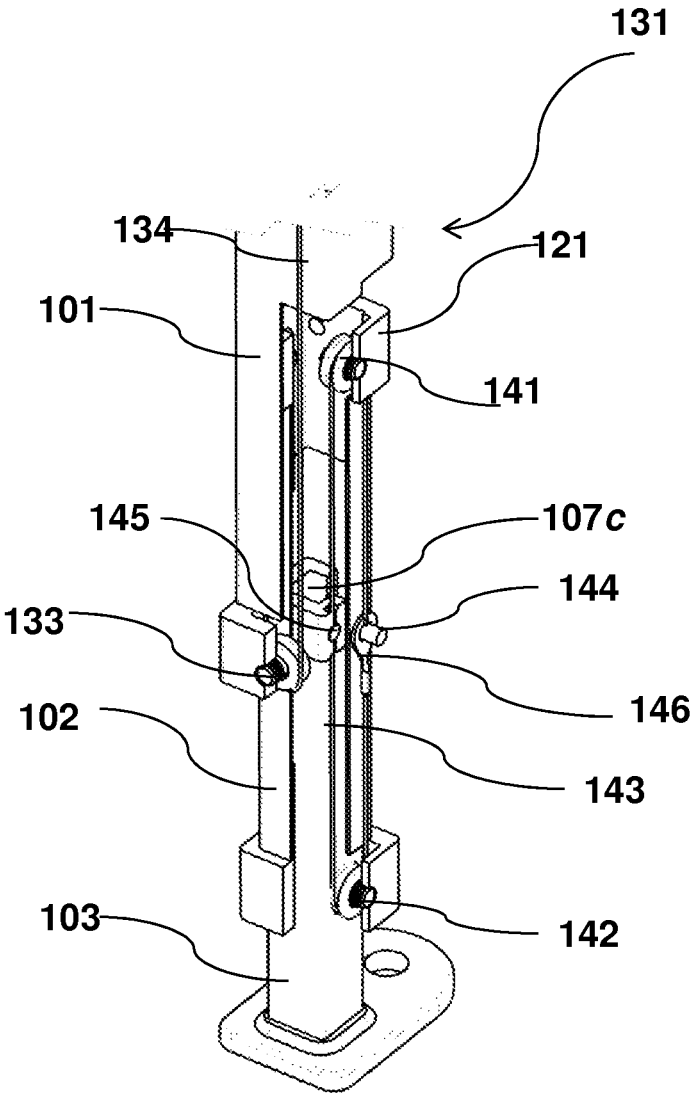
FIG. 25 illustrates a partial longitudinal section view of the telescopic leg with the lower cable assembly.

As shown in FIGS. 24 and 25, each telescopic leg 11 has two cable assemblies, an upper cable assembly 130 and a lower cable assembly 131. Each cable assembly consists of two pulleys and one cable. The pulleys are attached by a pin, or equivalent. As shown in FIG. 24, the upper cable assembly 130 has an upper pulley 132 and a lower pulley 133 and as shown in FIG. 27, a top cable 134 which has a first end 135 and a second end 136 and contains three dowel pins, a top dowel pin 137, a middle dowel pin 138 and a bottom dowel pin 139, which are combined into the top cable 134; the top towel pin 137 is found at the first end 135 of the top cable 134, bottom dowel pin 139 at the second end 136 of the top cable 134 and the middle dowel pin 138 is located between the top dowel pin 137 and bottom dowel pin 139 at a point to coincide with the engagement point at the middle plug 121. As shown in FIG. 23, the collar 123 of the middle plug 121 has a perpendicular groove 129 and a hole 140 on the sidewall 124*a* of the collar 123 so that the top cable 134 is firmly engaged into the sidewall 124*a* with the middle dowel pin 138 in order for the top cable 134 not interfere with the ability of the middle plug 121 to move with the middle telescopic section 102. The upper cable assembly 130 and the lower cable assembly 131 are designed to always move in the same direction. Referring back to FIG. 24, the path of the top cable 134 begins with the first end 135 of top cable 134 with the top dowel pin 137 connects on the outer side of the sliding bracket 21; next, the top cable 134 proceeds upwards and wraps around the upper pulley 132 which is attached by a pin, or equivalent, on the sidewall 113*a* of the top fitting sleeve's 109 collar 112; next, the top cable 134 proceeds downward in the hollow center of the top telescopic section 101 until the top cable 134 with the middle dowel pin 138 reaches the middle plug 121 where the top cable 134 is positioned in the groove 129 and firmly attached to the sidewall 124*a* of the collar 123 of the middle plug 121 at the hole 140 via the middle dowel pin 138. The top cable 134 continues downward until the top cable 134 reaches the lower pulley 133 which is attached by a pin, or equivalent, to the middle fitting sleeve 110 at the sidewall 116*a* of the collar 115; next, the top cable 134 with the bottom dowel pin 139 loops around the lower pulley 133 and turns upward to the sliding bracket 21 for attachment on the outer perimeter of the sliding bracket 21. Therefore, when the sliding bracket 21 moves upward due to either single activation feature 13, 45 in lock position, the top cable 134 begins to rotate counterclockwise causing the middle telescopic section 102 to extend.

Figure 26:
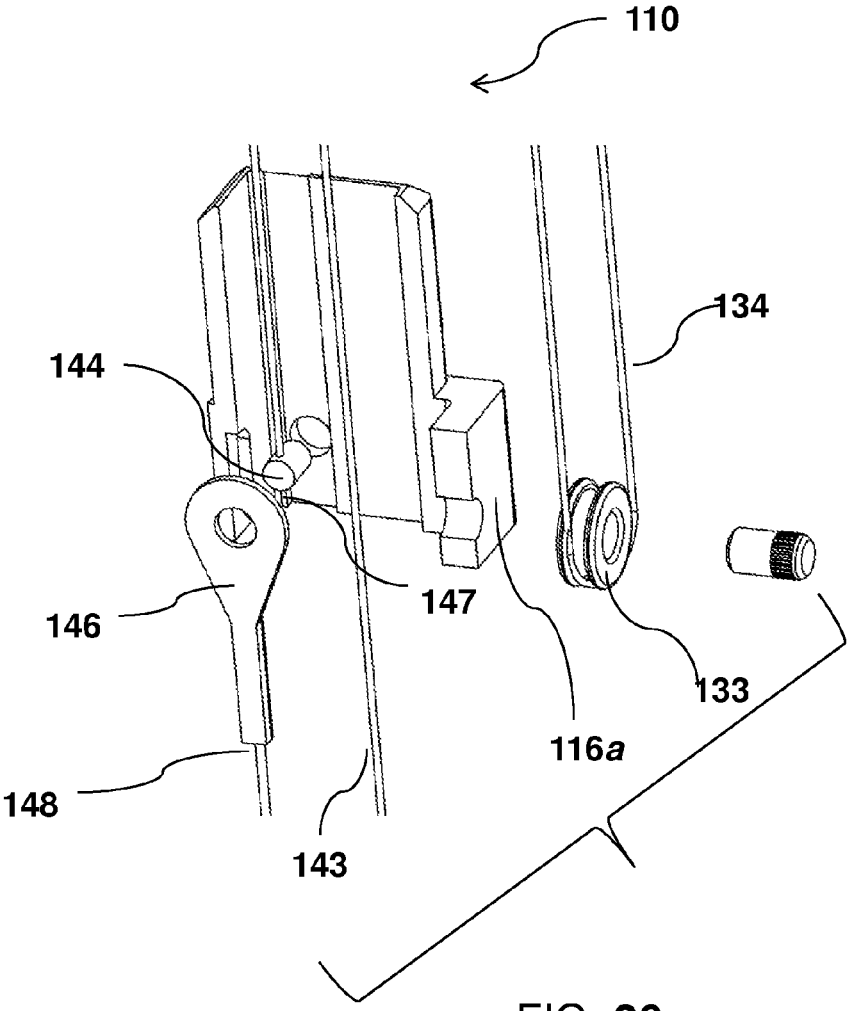
FIG. 26 illustrates a longitudinal section view of middle fitting sleeve and a partial exploded view of upper cable assembly and lower cable assembly.

Referring back to FIG. 25, the lower cable assembly 131 has two pulleys, an upper pulley 141 and a lower pulley 142, a bottom cable 143 with two dowel pins that are permanently incorporated into the bottom cable, a top dowel pin 144 and a middle dowel pin 145, and a ring terminal 146. Attached on the inside of the collar's 123 sidewall 124*b* of the middle plug 121 is the upper pulley 141; the attachment of the upper pulley 141 to the sidewall 124*b* is made from the exterior by a pin, or equivalent, The lower pulley 142 located on the inside of bottom fitting sleeve 117 and is attached with a pin, or equivalent, from the outside on the sidewall 120*a* of the collar 119. The middle plug 121, which is attached to the middle telescopic section 102, moves with the middle telescopic section 102. The lower cable assembly 131 connects the middle telescopic section 102 with the bottom telescopic section 103, so that when the middle telescopic section 102 moves downward, the bottom telescopic section moves downward and vice versa, when the middle telescopic section 102 moves upward (retracts), the bottom telescopic section 103 also retracts. As shown in FIG. 26, the bottom cable 143 has two ends, a first end 147 and a second end 148; the first end 147 with the top dowel pin 144 and the second end 148 with the ring terminal 146. The middle dowel pin 145 is located at a point between the top dowel pin 144 and the ring terminal 146. As shown in FIG. 26, the first end 147 with the top dowel pin 144 and the second end 148 with the ring terminal 146 are attached at the same point on the side of the middle fitting sleeve 110; additionally, as noted above, lower pulley 133 of the upper cable assembly 130 is also connected to the middle fitting sleeve 110. The bottom cable assembly 131 is situated 90 degrees from the upper cable assembly 130. As shown in FIG. 25, the path of the bottom cable 143 begins with the attachment of the first end 147 of the bottom cable 143 to the middle fitting sleeve 110 on the sidewall 116 of the collar 115; next, the bottom cable 143 moves upward between the middle telescopic section 102 and the top telescopic section 101 and the bottom cable 143 wraps around the upper pulley 141 of the lower cable assembly 131. Thereafter, the bottom cable 143 proceeds downward along the inside wall of the middle telescopic section 102 toward the bottom plug 125. As shown in FIG. 22, the collar 127 of the bottom plug 125 has a perpendicular groove 149 and a hole 150 on the sidewall 128*a* of the collar 127 so that the bottom cable 143 is firmly engaged into the sidewall 128*a* with the middle dowel pin 145 in order for the bottom cable 135 not interfere with the ability of the bottom plug 125 to move with the middle telescopic section 102. Next, the bottom cable 143 is placed into the perpendicular groove 149 and attaches to the sidewall 128*a* of the collar 127 by the middle dowel pin 145 through the hole 150. At this point, the bottom cable 143 is located between the inner portion of the middle telescopic section 102 and the outer portion of the bottom telescopic section 102, where the lower cable 143 continues downward and wraps around the lower pulley 142 of the lower cable assembly 131 changing direction upward where the second end 148 with the ring terminal 146 attaches to the middle fitting sleeve 110 at the same point on the sidewall 116*b* of the collar 115 as the first end 147 of bottom cable 143. As the middle telescopic section 102 moves downward when the upper cable assembly's 130 movement is initiated by the sliding bracket 21 moving upward, the bottom telescopic section 103 in turn moves downward until the single activation feature is in lock position.

Figure 29:
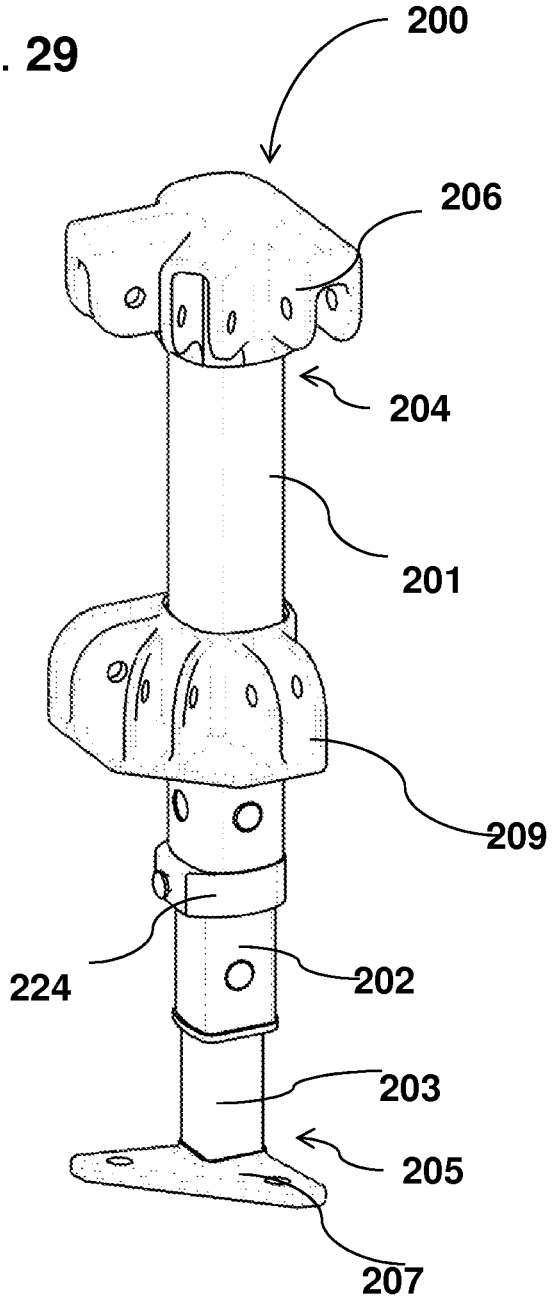
FIG. 29 illustrates a perspective view of a telescopic leg with a tape-driven telescopic leg.
Figure 30:
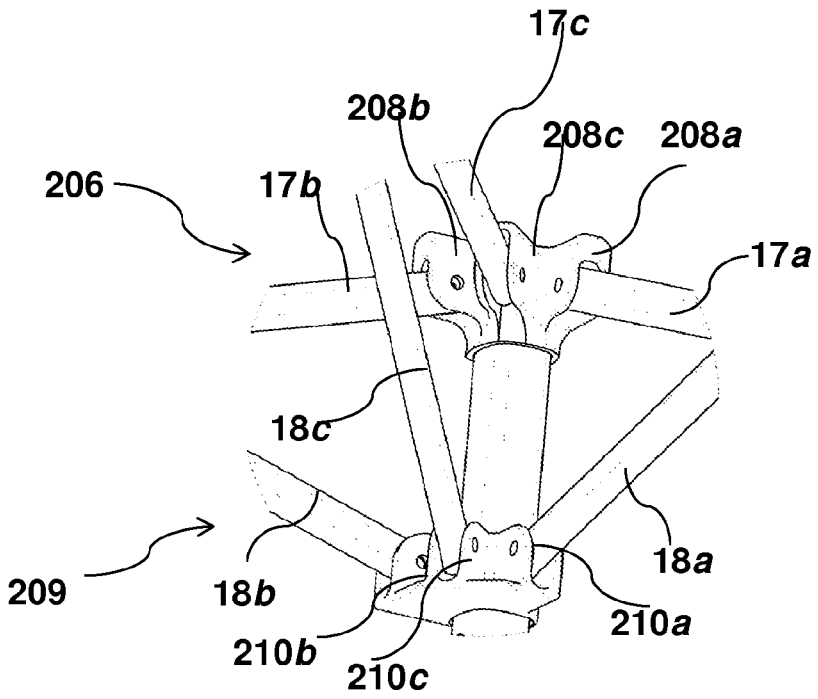
FIG. 30 illustrates a fixed bracket and a sliding bracket with a plurality of upper arms and lower arms attached.

FIGS. 29-41 illustrate an embodiment of a telescopic leg with a tape-driven motion system, a tape-driven telescopic leg 200, for achieving the extension and retraction of the collapsible gazebo frame 10 telescopic legs. The tape-driven telescopic leg 200 has effectively a square cross-section; in other examples, the telescopic legs 200 may have rectangular or other cross-sectional shapes. As shown in FIG. 29, each tape-driven telescopic leg 200 consists of three sections: top telescopic section 201, middle telescopic section 202 and bottom telescopic section 203. Each tape-driven telescopic section (201, 202, and 203) has an essentially square cross-section, where the cross-section of the middle telescopic section 202 is smaller than the cross-section of the top telescopic section 201, and the cross-section of the bottom telescopic section 203 is smaller than the cross-section of the middle telescopic section 202. The tape-driven telescopic leg 200 has an upper end 204 and a lower end 205. Located at the upper end 204 of each tape-driven telescopic leg 200 is a fixed bracket 206 used for connecting the central supports 14 and the side supports 12, and attached to the lower end 205 of the tape-driven telescopic leg 200 is a pedestal foot 207 to stabilize the tape-driven telescopic leg 200 when the collapsible gazebo frame 10 is in the open (erect) position. As shown in FIG. 30, the fixed bracket 206 includes a first coupler 208*a* for the attachment of the upper arm 17*a* of the first side support 12*a*, a second coupler 208*b* for the attachment of the upper arm 17*b* of the second side support 12*b*, and a third coupler 208*c* for the attachment of the upper arm 17*c* of the second end of the central support 14*a*. A sliding bracket 209 is attached to the top telescopic section 201 and is located below the fixed bracket 205. The sliding bracket 209 is movable between a first position when the collapsible gazebo frame 10 is collapsed (closed position) and a second position when the collapsible gazebo frame 10 is deployed (open position). The sliding bracket 209 has a first coupler 210*a* for the attachment of the lower arm 18*a* of the first side support 12*a*, second coupler 210*b* for the attachment of the lower arm 18*b* of the second side support 12*b*, and a third coupler 210*c* for the attachment of the lower arm 18*c* of the second end of the central support 14*a*.

Figure 34:
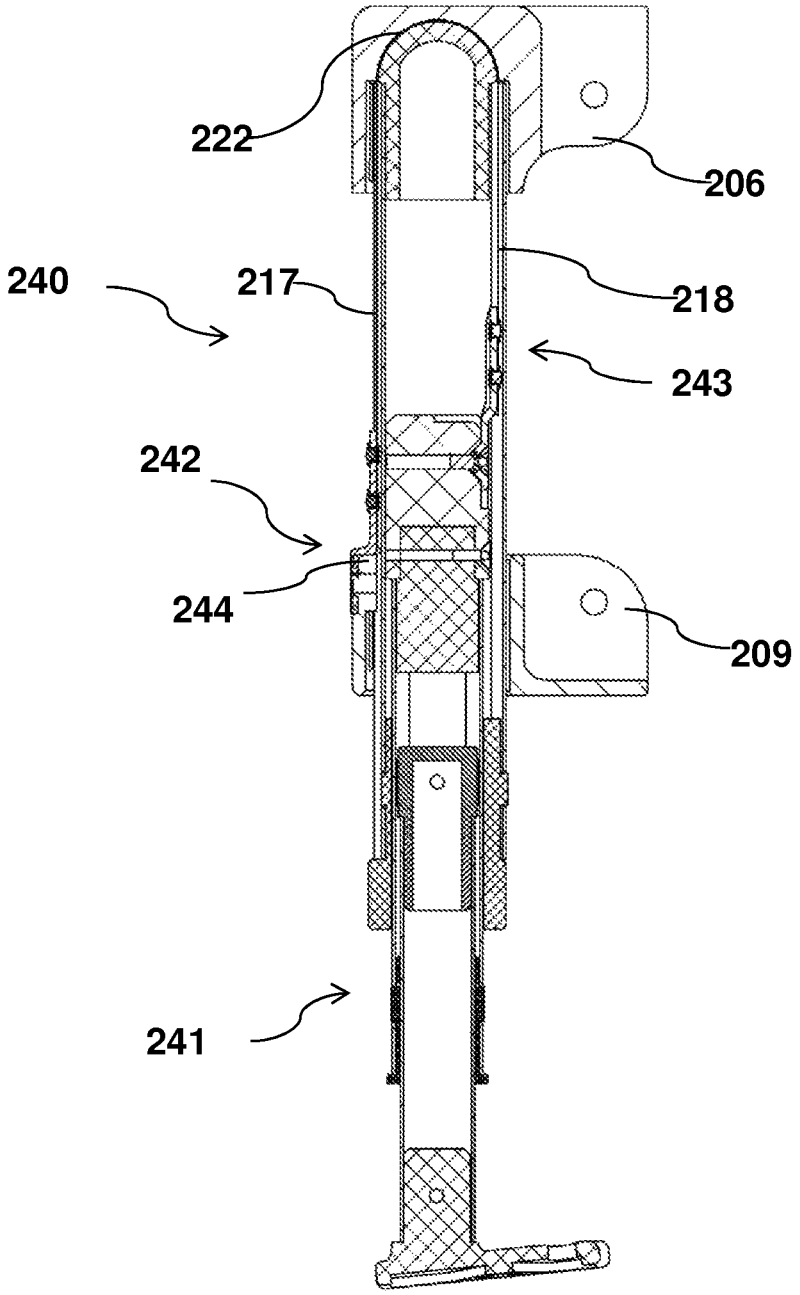
FIG. 34 illustrates a longitudinal section view of tape-driven telescopic leg with upper and lower tapes.

As shown in FIGS. 31-32, the top telescopic section 201 has an upper end 213 and a lower end 214, and two opposite sidewalls, a first sidewall 215 and a second sidewall 216, each sidewall 215, 216 includes a narrow track from top to bottom, a first track 217 and a second track 218; and the fixed bracket 206 provides closure to the top telescopic section 201 with an underside 211 semi-circle curved shape. A four sided top plug 219 is inserted at the upper end 213 of the top telescopic section 201; and a middle fitting sleeve 220 is inserted into the lower end 214 of the top telescopic section 201. The top plug 219 is designed to fit tightly into the upper end 213 of the top telescopic section 201 and is in the same shape as the top telescopic 201 cross-section. As illustrated in FIG. 33, the top plug 219 has a semi-circle curved shaped dome 221 that extends beyond the upper end 213 and rests on the edge of the top telescopic section 201. The semi-circle curved shaped dome 221 of the top plug 219 and the curvature shape of the underside 211 of the fixed bracket 206 create a narrow arc-shaped space 222, as shown in FIG. 34. The middle fitting sleeve 220 is designed to fit tightly into the lower end 214 of the top telescopic section 201; the middle fitting sleeve 220 has a collar 224 that rests on the outer edge below the lower end 214 of the top telescopic section 201.

Figure 35:
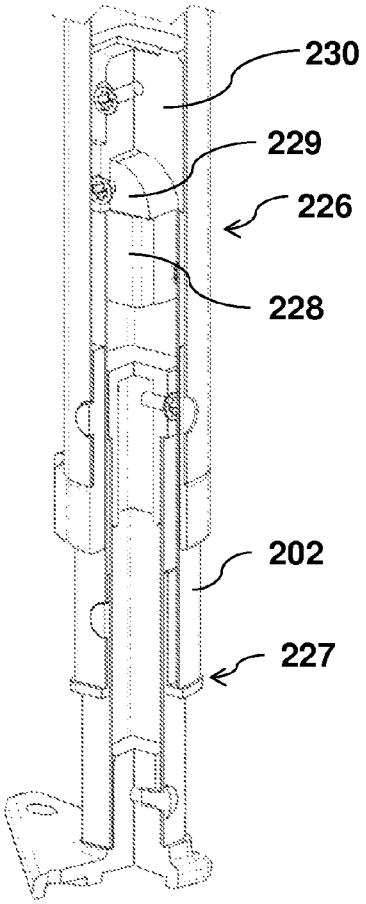
FIG. 35 illustrates a partially broken-away perspective view of middle telescopic section and bottom telescopic section.
Figure 36:
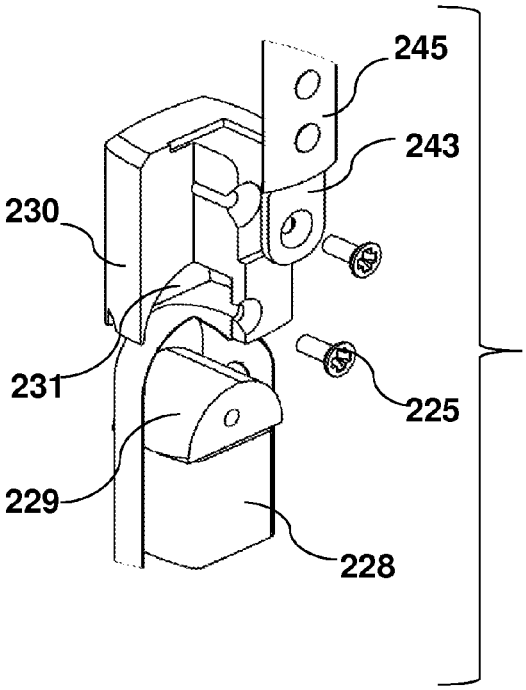
FIG. 36 illustrates a perspective view of the middle plug and its cap.
Figure 37:
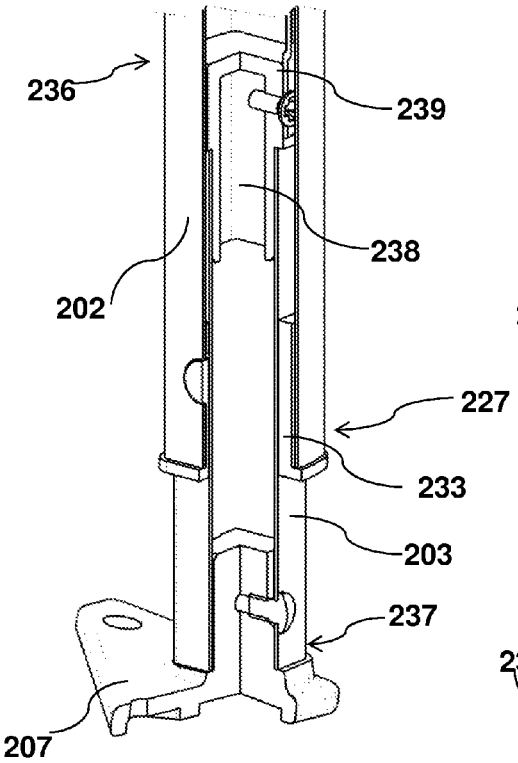
FIG. 37 illustrates a partially broken-away perspective view of the bottom telescopic section.
Figure 38:
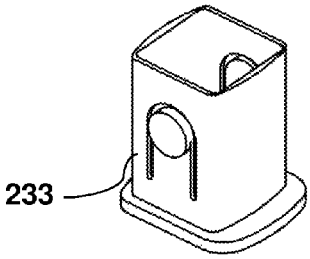
FIG. 38 illustrates a bottom fitting sleeve.

As shown in FIG. 35, the middle telescopic section 202 has an upper end 226 and a lower end 227, and includes a middle plug 228 with a semi-circle curved shaped dome 229 that extends beyond the outer edge of the upper end 226 of the middle telescopic section 202, and the middle plug 228 is designed to fit tightly in the upper end 226 of the middle telescopic section 202. As shown in FIG. 36, attached to the middle plug 228 is cap 230 which is attached to the middle plug 228 by a screw 225, or equivalent. The cap 230 has a curved underside 231. The curved shaped dome 229 of the middle plug 228 and the curved shape of the underside 231 of the cap 230 create a narrow arc-shaped space 232, as shown in FIG. 46. FIGS. 37 and 38 illustrate a hollow four sided bottom fitting sleeve 233 is attached at the lower end 227 of the middle telescopic section 202 and the purpose of the bottom fitting sleeve 233 is to prevent the bottom telescopic section 203 from being separated from the middle telescopic section 202. The middle telescopic section 202 has a sidewall 234 with a narrow track 235 which is positioned 90 degrees from the top section tracks 217, 218. The bottom telescopic section 203 has an upper end 236 and a lower end 237. A four sided bottom plug 238 with a collar 239 is attached to the upper end 236 of the bottom telescopic section 203. The lower end 237 of the bottom telescopic section 203 is attached to the pedestal 207.

Figure 41:
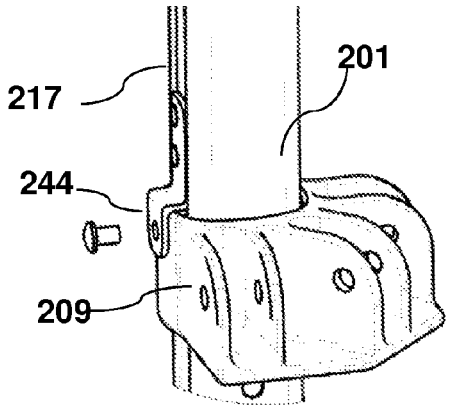
FIG. 41 illustrates the first end of upper tape and location of attachment on sliding bracket.
Figure 40:
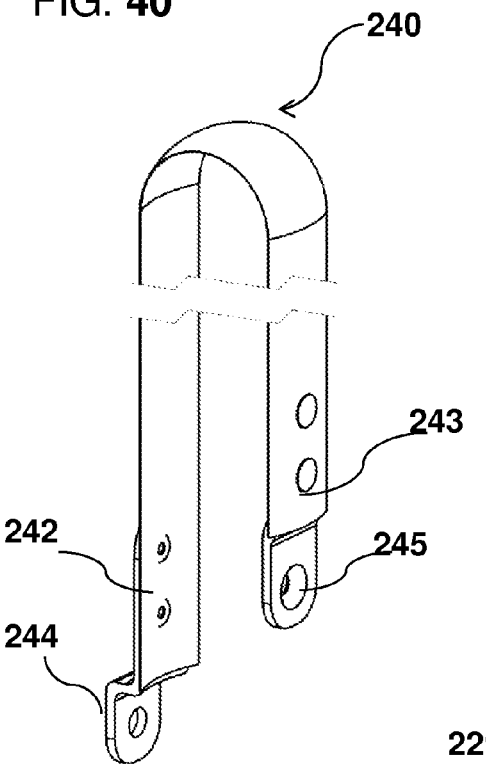
FIG. 40 illustrates the upper tape with fasteners.
Figure 42:
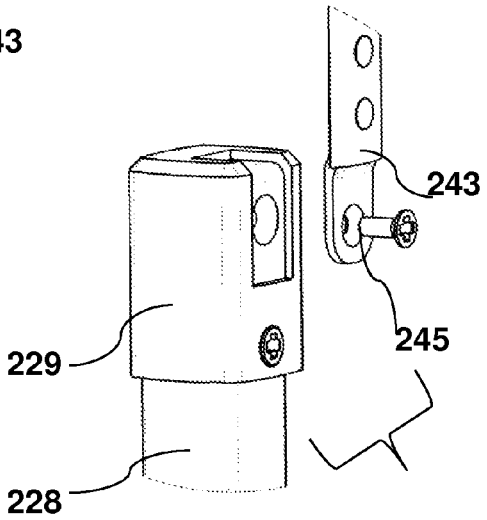
FIG. 42 illustrates the second end of upper tape and location of attachment on cap of mid plug.

Each tape-driven telescopic leg 200 has two metal tapes, an upper tape 240 and a lower tape 241. The upper tape 240 and the lower tape 241 are structured to move in the same direction. As shown in FIG. 40, the upper tape 240 has a first end 242 and a second end 243. Referring back to FIG. 34, the upper tape 240 is placed in tracks 217, 218 and the arc-shaped space 222. As shown in FIG. 41, the first end 242 of the upper tape 240 located in the first track 217 is attached to the sliding bracket 209 by a first fastener 244 on the outer wall of the sliding bracket 209; referring now to FIG. 42, the second end 243 is attached to the cap 229 of the middle plug 228 by a second fastener 245. Therefore, when the sliding bracket 209 moves upward caused by the single activation point feature in locked position, the upper tape 240 is pushed upward in the first track 217 and into the arc-shaped space 222. Due the narrow space of the arc-shaped space 222, the upper tape 240 is forced to move within the space causing the movement of the upper tape 240 to transfer toward the second end of tape 243 in the second track 218 which triggers the middle telescopic section 202 to move downward. Vice versa, when the single activation feature is in the unlock position, the sliding bracket 209 moves downward causing the upper tape 240 to move upward and the middle telescopic section 202 to retract.

Figure 39:
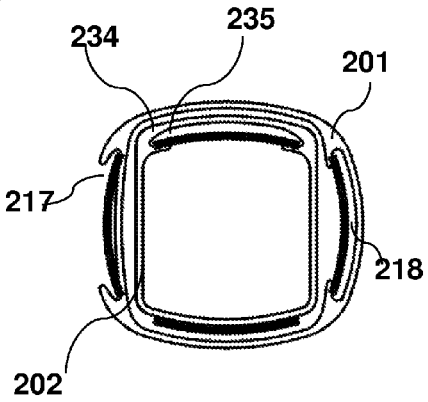
FIG. 39 illustrates a cross section of the top and middle telescopic sections with the upper and lower tapes in tracks.

The lower tape 241 connects the middle telescopic section 202 with the bottom telescopic section 203. As shown in FIG. 39, the lower tape 241 is situated 90 degrees from the upper tape 240 so that the upper tape and the lower tape are not on the located on the same side to ensure that the tapes 240, 241 during movement do not to interfere with each other. Therefore, as the middle telescopic section 202 moves downward, the bottom telescopic section 203 moves downward, and vice versa. As shown in FIGS. 43-46, the lower tape 241 has two ends, a first end 246 and a second end 247; the lower tape 241 path begins with the attachment of the first end 246 of the lower tape 241 to the collar 224 of the middle fitting sleeve 220 by a first fastener 248; next, the lower tape 241 is placed between the outer side of the sidewall of the middle telescopic section 202 but on the inner side of the sidewall of the top telescopic section 201. As the lower tape 241 reaches the upper end 226 of the middle telescopic section 202, the lower tape 241 continues in the narrow arch-shaped space 232. The lower tape 241 changes direction and continues downward in the track 235 of the sidewall 234 of the middle telescopic section 202 until the tape reaches the bottom plug 238. The second end 247 of the lower tape 241 is attached to the collar 239 of the bottom plug 238 by a second fastener 249. As the middle telescopic section 202 moves downward when the sliding bracket 209 moves up, the lower tape 241 in the narrow arc-shaped space 232 and in the track 235 of the sidewall 234 is forced to move downward causing the bottom telescopic section 203 to move downward. Vice versa, when the middle telescopic section 202 is pulled upward, the middle plug 227 is also pulled upward causing the bottom telescopic section 203 to move upward as well.

When describing elements or features and/or embodiments thereof, the articles "a", "an", "the", "each", and "said" are intended to mean that there are one or more of the elements or features. The terms "comprising", "including", and "having" are intended to be inclusive and mean that there may be additional elements or features beyond those specifically described.

Those skilled in the art will recognize that various changes can be made to the exemplary embodiments and implementations described above without departing from the scope of the disclosure. Accordingly, all matter contained in the above description or shown in the accompanying drawings should be interpreted as illustrative and not in limiting sense.

It is further to be understood that the processes or steps described herein are not to be construed as necessarily requiring their performance in the particular order discussed or illustrated. It is also understood that additional or alternative processes or steps may be employed.

What is claimed is:

1. A collapsible gazebo frame with a single activation feature comprising:

a single activation feature;

a plurality of telescopic legs wherein each telescopic leg further comprising a cable system comprising:

a plurality of telescopic sections;

a plurality of cable assemblies wherein each cable assembly comprising a cable and two pulleys;

a plurality of plugs;

a plurality of fitting sleeves;

whereby the plugs and fitting sleeves facilitate the interconnection of the telescopic sections and provide for the attachment of the cable and the pulleys to enable the extension and retraction of the telescopic sections and thus the extension and retraction of the telescopic leg by the single activation feature;

a plurality of side supports wherein each side support having an upper and a lower arm for coupling the telescopic legs to one another;

a plurality of central supports wherein each central support having an upper and a lower arm for coupling the telescopic legs to the single activation mechanism and wherein each upper and lower arm of each central support having a first end and a second end;

a plurality of fixed brackets wherein the second end of the upper arm of the central support and the upper arm of the one end of two adjacent side supports are connected;

a plurality of sliding brackets wherein the second end of the lower arm of the central support and the lower arm of the one end of two adjacent side supports are connected;

whereby the single activation mechanism triggers the extension and retraction of the side and central supports.

2. The collapsible gazebo frame with a single activation feature of claim 1, wherein the single activation feature further comprising a cable-pin single activation feature comprising:

an upper hub comprising a plurality of couplers for coupling the first end of the upper arm of the central supports;

a lower hub comprising a plurality of couplers for coupling the first end of the lower arm of the central supports;

a pole to facilitate the engagement of the lower hub with the upper hub comprising:

a hollow housing;

a locking pin;

a return spring;

a lever;

a cable connecting the lever to the locking pin;

whereby the lever, when pressed downward, triggers the locking pin to retreat from the upper hub causing the lower hub to disengage from the upper hub and thus facilitating the collapse of the gazebo frame.

* * * * *